US006539283B2

(12) United States Patent
Takagi

(10) Patent No.: US 6,539,283 B2
(45) Date of Patent: Mar. 25, 2003

(54) ROBOT AND ACTION DECIDING METHOD FOR ROBOT

(75) Inventor: Tsuyoshi Takagi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/821,679

(22) Filed: Mar. 29, 2001

(65) Prior Publication Data

US 2002/0024312 A1 Feb. 28, 2002

(30) Foreign Application Priority Data

Mar. 31, 2000 (JP) ..... 2000-101349

(51) Int. Cl.[7] ..... G06F 19/00

(52) U.S. Cl. ..... 700/245; 700/31; 700/248; 700/258; 700/261; 318/568.1; 318/568.11; 318/568.12; 318/569; 901/1; 901/15; 901/47

(58) Field of Search ..... 700/261, 245, 700/31, 259, 248, 258; 318/568.1, 568.11, 568.12, 569, 16, 565; 901/1, 15, 47; 704/209, 207, 270; 348/121; 706/25, 19, 27

(56) References Cited

U.S. PATENT DOCUMENTS 4,657,104 A * 4/1987 Holland ..... 180/211
5,963,712 A * 10/1999 Fujita et al. ..... 318/568.12
6,038,493 A * 3/2000 Tow ..... 700/259
6,058,385 A * 5/2000 Koza et al. ..... 706/13
6,275,773 B1 * 8/2001 Lemelson et al. ..... 340/436
6,321,140 B1 * 11/2001 Fujita et al. ..... 250/253

OTHER PUBLICATIONS

Breazeal et al., Infant–like social interactions between a robot and a human caregiver, 1998, Internet, p.1–p.44.*

Ishiguro et al., Robovie: A robot generates episode claims in our daily file, 2001, Internet, pp. 1–4.*

* cited by examiner

*Primary Examiner*—William A. Cuchlinski, Jr.
*Assistant Examiner*—McDieunel Marc
(74) *Attorney, Agent, or Firm*—Frommer Lawrence & Haug LLP; William S. Frommer; Gordon Kessler

(57) ABSTRACT

A robot device 1 has a sensor 101 for detecting information of a user, a user identification section 120 for identifying one user from a plurality of identifiable users on the basis of the information of the user detected by the sensor 101, and an action schedule section 130, an action instruction execution section 103 and an output section 104 as action control means for manifesting an action corresponding to the one user identified by the user identification section 120.

6 Claims, 19 Drawing Sheets

| | NAME OF INPUT EVENT | NAME OF DATA | RANGE OF DATA | TRANSITION PROBABILITY TO OTHER NODES Di | | | | | |
|---|---|---|---|---|---|---|---|---|---|
| node 100 | | | | A | B | C | D | | n |
| TRANSITION DESTINATION NODE | | | | node 120 | node 120 | node 1000 | | | node 600 |
| OUTPUT ACTION | | | | ACTION 1 | ACTION 2 | MOVE BACK | | | ACTION 4 |
| 1 | BALL | SIZE | 0.1000 | 30% | | | | | |
| 2 | PAT | | | | 40% | | | | |
| 3 | HIT | | | | 20% | | | | |
| 4 | MOTION | | | | | 50% | | | |
| 5 | OBSTACLE | DISTANCE | 0.100 | | | 100% | | | |
| 6 | | JOY | 50.100 | | | | | | |
| 7 | | SUPRISE | 50.100 | | | | | | |
| 8 | | SADNESS | 50.100 | | | | | | |
| | | | | | | | | | |

80

FIG.8

ROBOT AND ACTION DECIDING METHOD FOR ROBOT

BACKGROUND OF THE INVENTION

1. Field of the Invention

This invention relates to a robot and an action deciding method for deciding the action of the robot.

2. Description of the Related Art

Recently, there has been proposed a robot which autonomously acts in accordance with ambient information (external elements) and internal information (internal elements). For example, such a robot is exemplified by a so-called pet robot as a robot device in the format of an animal, a mimic organism, or a virtual organism displayed on a display or the like of a computer system.

The above-described robot devices can autonomously act, for example, in accordance with a word or an instruction from a user. For example, the Japanese Publication of Unexamined Patent Application No. H10-289006 discloses a technique of deciding the action on the basis of pseudo emotions.

Meanwhile, all the conventional robot devices react in the same manner to every user. That is, the robot devices react uniformly to different users and do not change their reactions depending on the users.

If the robot devices identify the users and react differently to the different users, it is possible to enjoy interactions with each user

SUMMARY OF THE INVENTION

Thus, in view of the foregoing status of the art, it is an object of the present invention to provide a robot which reacts differently to different users, and an action deciding method for the robot.

A robot according to the present invention comprises: detection means for detecting information of a user; identification means for identifying one user from a plurality of identifiable users on the basis of the information of the user detected by the detection means; and action control means for manifesting an action corresponding to the one user identified by the identification means.

In the robot having such a structure, one user is identified from a plurality of identifiable users by the identification means on the basis of the information of the user detected by the detection means, and an action corresponding to the one user identified by the identification means is manifested by the action control means.

Thus, the robot identifies one user from a plurality of identifiable users and reacts corresponding to the one user.

An action deciding method for a robot according to the present invention comprises the steps of identifying one user from a plurality of identifiable users on the basis of information of the user detected by detection means, and manifesting an action corresponding to the identified one user.

In accordance with this action deciding method for a robot, the robot identifies one user from a plurality of identifiable users and reacts corresponding to the one user.

BRIEF DESCRIPTION OF THE DRAWINGS

FIG. 8 shows a state transition table prepared for each node of the finite probability automaton.

DESCRIPTION OF THE PREFERRED EMBODIMENTS

A preferred embodiment of the present invention will now be described in detail with reference to the drawings. In this embodiment, the present invention is applied to a robot device which autonomously acts in accordance with ambient information and internal information (information of the robot device itself).

In the embodiment, the structure of the robot device will be described first, and then the application of the present invention to the robot device will be described in detail.

(1) Structure of Robot Device According to Embodiment

Figure 1:
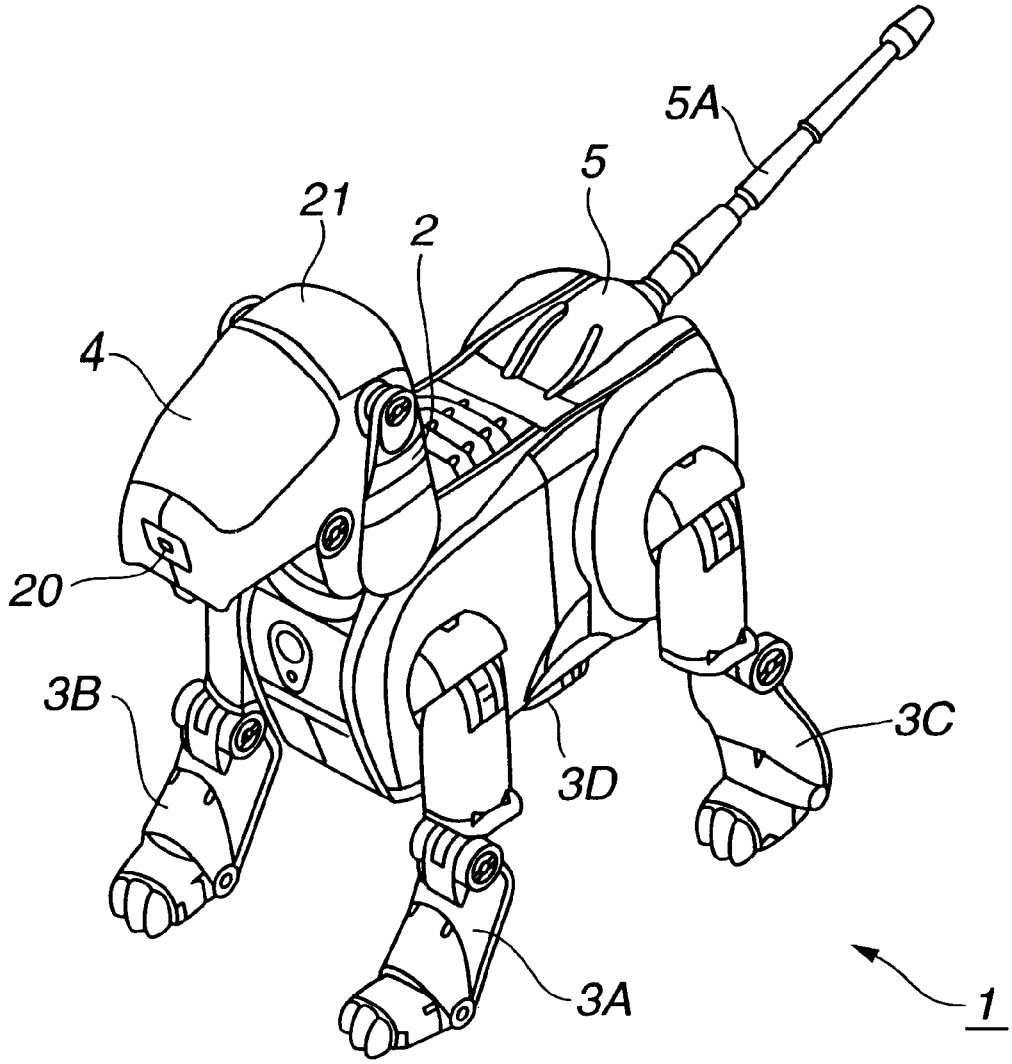
FIG. 1 is a perspective view showing the exterior structure of a robot device as an embodiment of the present invention.

As shown in FIG. 1, a robot device 1 is a so-called pet robot imitating a "dog". The robot device 1 is constituted by connecting limb units 3A, 3B, 3C and 3D to front and rear portions on the right and left sides of a trunk unit 2 and connecting a head unit 4 and a tail unit 5 to a front end portion and a rear end portion of the trunk unit 2, respectively.

Figure 2:
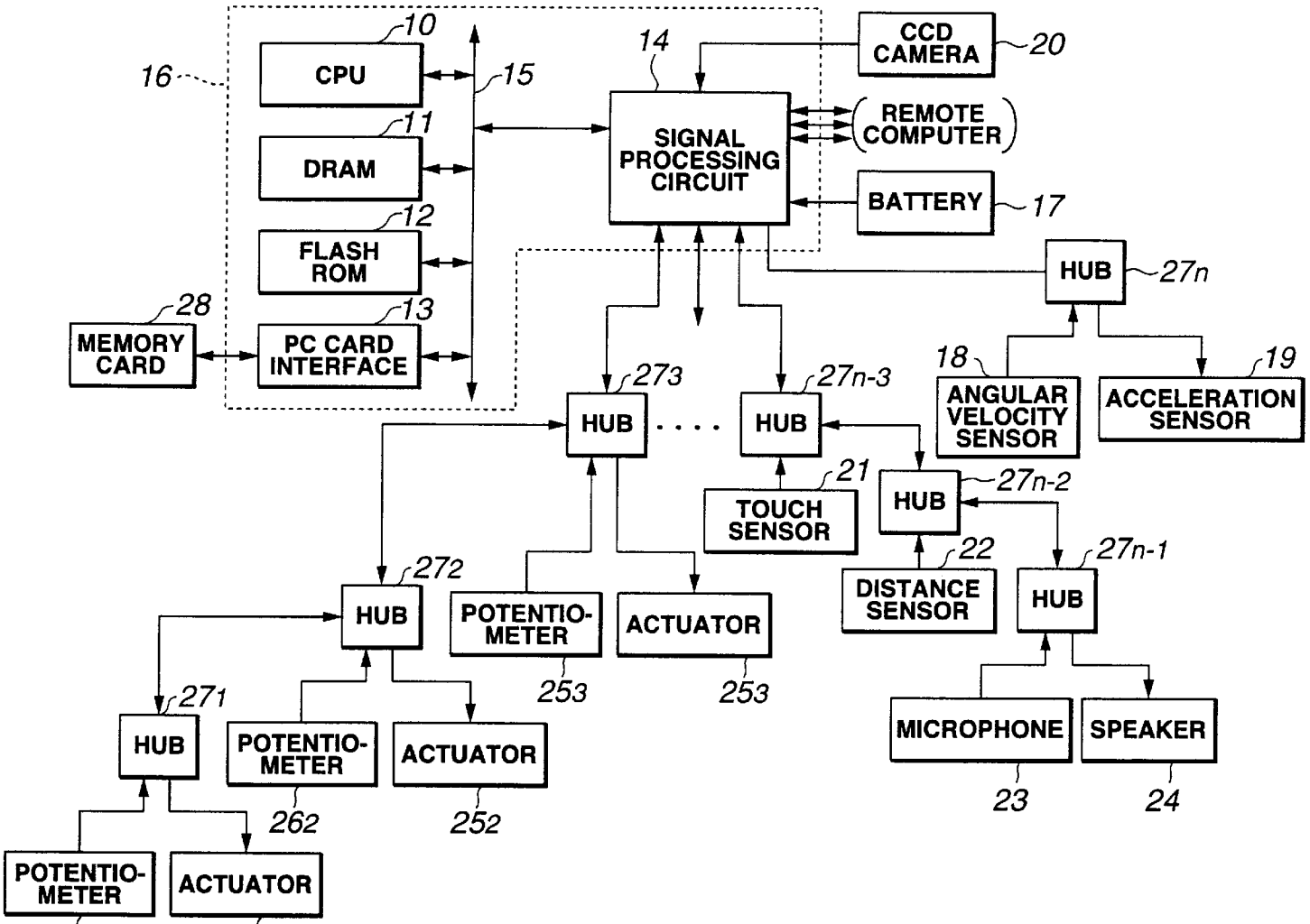
FIG. 2 is a block diagram showing the circuit structure of the robot device.

In the trunk unit 2, a control section 16 formed by interconnecting a CPU (central processing unit) 10, a DRAM (dynamic random access memory) 11, a flash ROM (read only memory) 12, a PC (personal computer) card interface circuit 13 and a signal processing circuit 14 via an internal bus 15, and a battery 17 as a power source of the robot device 1 are housed, as shown in FIG. 2. Also, an angular velocity sensor 18 and an acceleration sensor 19 for detecting the direction and acceleration of motion of the robot device 1 are housed in the trunk unit 2.

In the head unit 4, a CCD (charge coupled device) camera 20 for imaging the external status, a touch sensor 21 for detecting the pressure applied through a physical action like "stroking" or "hitting" by a user, a distance sensor 22 for measuring the distance to an object located forward, a microphone 23 for collecting external sounds, a speaker 24 for outputting a sound such as a bark, and a LED (light emitting diode) (not shown) equivalent to the "eyes" of the robot device 1 are arranged at predetermined positions.

Moreover, at the joint portions of the limb units 3A to 3D, the connecting portions between the limb units 3A to 3D and the trunk unit 2, the connecting portion between the head unit 4 and the trunk unit 2, and the connecting portion of a tail 5A of the tail unit 5, actuators $\mathbf{25}_1$ to $\mathbf{25}_n$ and potentiometers $\mathbf{26}_1$ to $\mathbf{26}_n$, having corresponding degrees of freedom are provided.

These various sensors such as the angular velocity sensor 18, the acceleration sensor 19, the touch sensor 21, the distance sensor 22, the microphone 23, the speaker 24 and the potentiometers $\mathbf{26}_1$ to $\mathbf{26}_n$, and the actuators $\mathbf{25}_1$ to $\mathbf{25}_n$ are connected with the signal processing circuit 14 of the control section 16 via corresponding hubs $\mathbf{27}_1$ to $\mathbf{27}_n$. The CCD camera 20 and the battery 17 are directly connected with the signal processing circuit 14.

The signal processing circuit 14 sequentially takes therein sensor data, image data and sound data supplied from the above-described sensors, and sequentially stores these data at predetermined positions in the DRAM 11 via the internal bus 15. Also, the signal processing circuit 14 sequentially takes therein remaining battery capacity data expressing the remaining battery capacity supplied from the battery 17 and stores this data at a predetermined position in the DRAM 11.

The sensor data, image data, sound data, and remaining battery capacity data thus stored in the DRAM 11 are later used by the CPU 10 for controlling the operation of the robot device 1.

In practice, in the initial state when the power of the robot device 1 is turned on, the CPU 10 reads out, directly or via the interface circuit 13, a control program stored in a memory card 28 charged in a PC card slot, not shown, in the trunk unit 2 or stored in the flash ROM 12, and stores the control program into the DRAM 11.

Later, the CPU 10 discriminates the status of the robot device itself, the ambient status, and the presence/absence of an instruction or action from the user, on the basis of the sensor data, image data, sound data, remaining battery capacity data which are sequentially stored into the DRAM 11 from the signal processing circuit 14 as described above.

Moreover, the CPU 10 decides a subsequent action on the basis of the result of discrimination and the control program stored in the DRAM 11, and drives the necessary actuators $\mathbf{25}_1$ to $\mathbf{25}_n$ on the basis of the result of decision. Thus, the CPU 10 causes the robot device 1 to shake the head unit 4 up/down and left/right, or to move the tail 5A of the tail unit 5, or to drive the limb units 3A to 3D to walk.

In this case, the CPU 10 generates sound data, if necessary, and provides this sound data as a sound signal via the signal processing circuit 14 to the speaker 24, thus outputting a sound based on the sound signal to the outside. The CPU 10 also turns on or off the LED, or flashes the LED.

In this manner, the robot device 1 can autonomously act in accordance with the status of itself, the ambient status, and an instruction or action from the user.

(2) Software Configuration of Control Program

Figure 3:
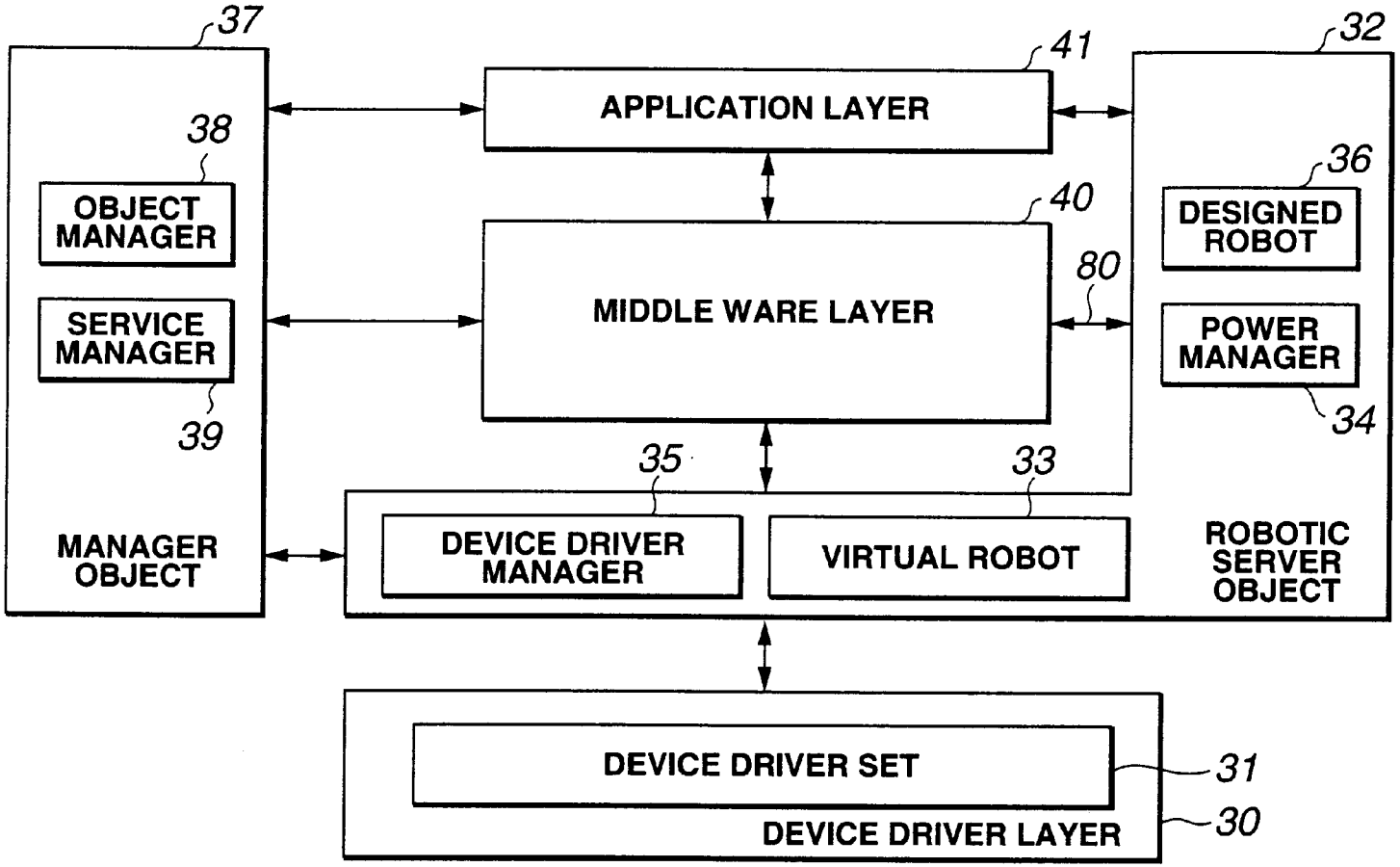
FIG. 3 is a block diagram showing the software configuration of the robot device.

The software configuration of the above-described control program in the robot device 1 is as shown in FIG. 3. In FIG. 3, a device driver layer 30 is located on the lowermost layer of the control program and is constituted by a device driver set 31 made up of a plurality of device drivers. In this case, each device driver is an object that is permitted to directly access the hardware used in an ordinary computer such as the CCD camera 20 (FIG. 2) and a timer, and carries out processing in response to an interruption from the corresponding hardware.

A robotic server object 32 is located on an upper layer than the device driver layer 30, and is constituted by a virtual robot 33 made up of a software group for providing an interface for accessing the hardware such as the above-described various sensors and the actuators $\mathbf{25}_1$ to $\mathbf{25}_n$, a power manager 34 made up of a software group for managing switching of the power source, a device driver manager 35 made up of a software group for managing various other device drivers, and a designed robot 36 made up of a software group for managing the mechanism of the robot device 1.

A manager object 37 is constituted by an object manager 38 and a service manager 39. In this case, the object manager 38 is a software group for managing the start-up and termination of the software groups contained in the robotic server object 32, a middleware layer 40 and an application layer 41. The service manager 39 is a software group for managing the connection of objects on the basis of connection information between objects described in a connection file stored in the memory card 28 (FIG. 2).

The middleware layer 40 is located on an upper layer than the robotic server object 32 and is constituted by a software group for providing the basic functions of the robot device 1 such as image processing and sound processing. The application layer 41 is located on an upper layer than the middleware layer 40 and is constituted by a software group for deciding the action of the robot device 1 on the basis of the result of processing carried out by the software group constituting the middleware layer 40.

Figure 4:
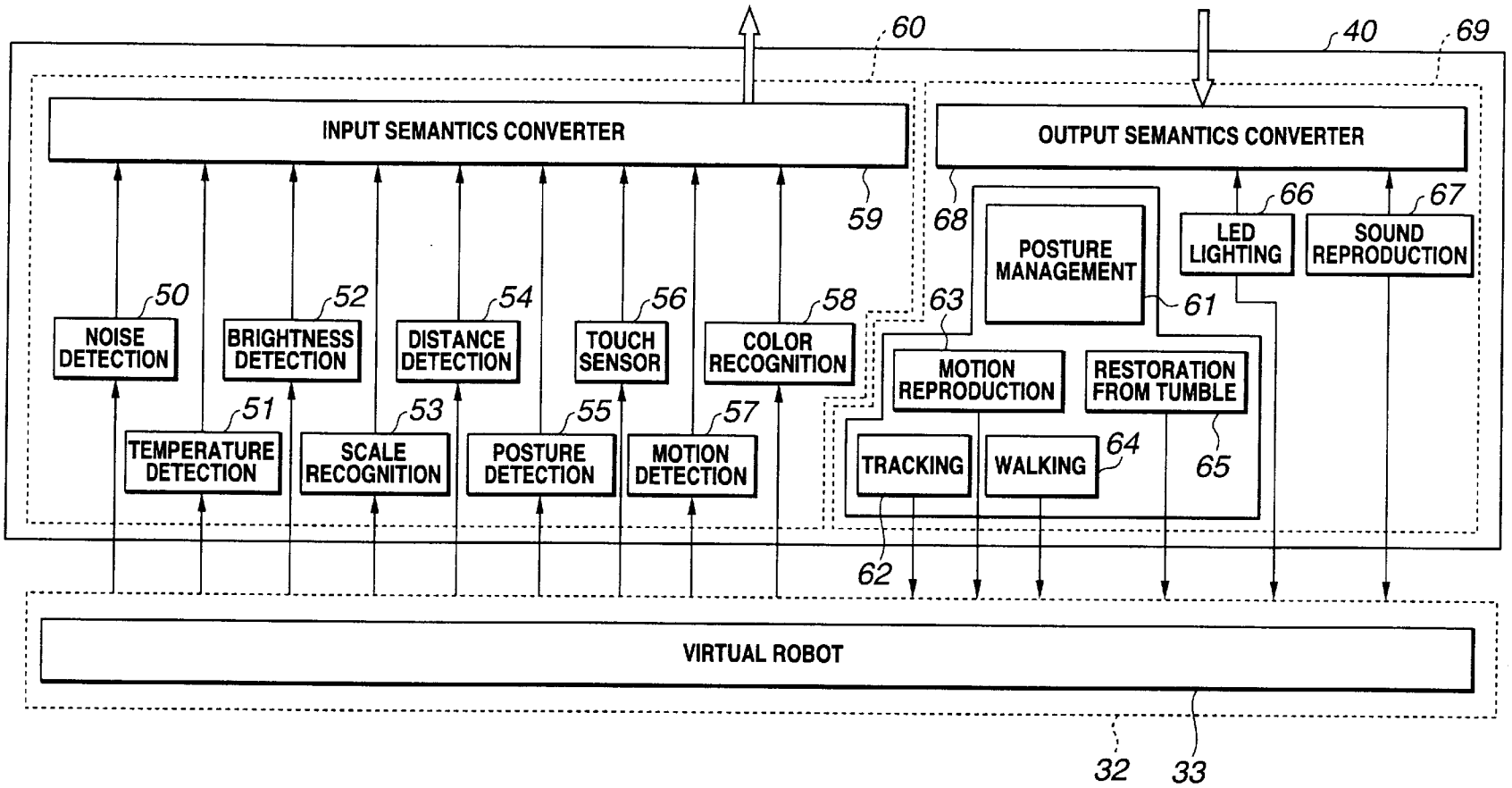
FIG. 4 is a block diagram showing the configuration of a middleware layer in the software configuration of the robot device.
Figure 5:
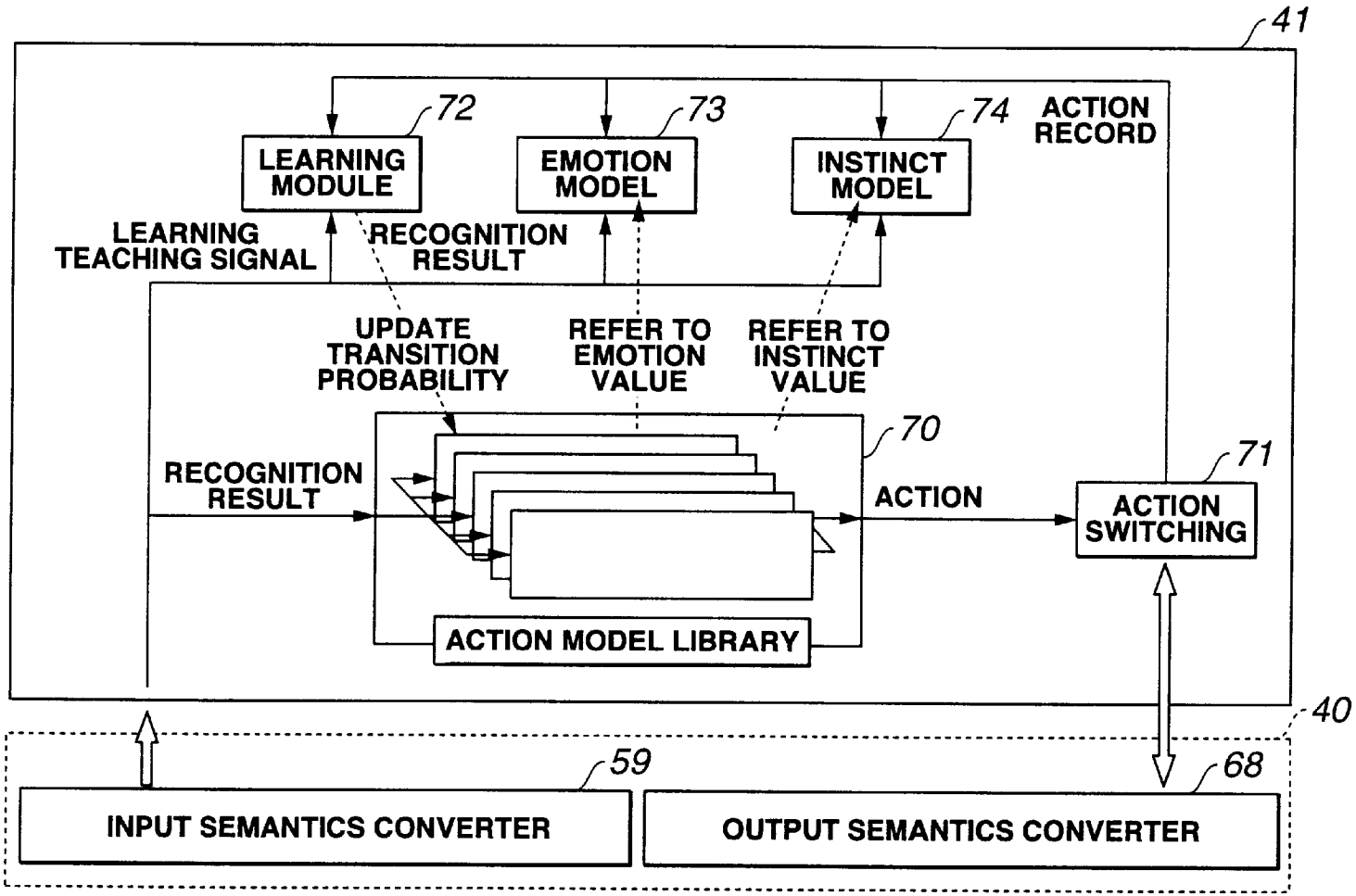
FIG. 5 is a block diagram showing the configuration of an application layer in the software configuration of the robot device.

The specific software configurations of the middleware layer 40 and the application layer 41 are shown in FIGS. 4 and 5, respectively.

The middleware layer 40 is constituted by: a recognition system 60 having signal processing modules 50 to 58 for noise detection, temperature detection, brightness detection, scale recognition, distance detection, posture detection, touch sensor, motion detection, and color recognition, and an input semantics converter module 59; and a recognition system 69 having an output semantics converter module 68, and signal processing modules 61 to 67 for posture management, tracking, motion reproduction, walking, restoration from tumble, LED lighting, and sound reproduction, as shown in FIG. 4.

The signal processing modules 50 to 58 in the recognition system 60 take therein suitable data of the various sensor data, image data and sound data read out from the DRAM 11 (FIG. 2) by the virtual robot 33 of the robotic server object 32, then performs predetermined processing based on the data, and provides the result of processing to the input semantics converter module 59. In this case, the virtual robot 33 is constituted as a unit for supplying/receiving or converting signals in accordance with a predetermined protocol.

The input semantics converter module 59 recognizes the status of itself and the ambient status such as "it is noisy", "it is hot", "it is bright", "I detected a ball", "I detected a tumble", "I was stroked", "I was hit", "I beard a scale of do-mi-sol", "I detected a moving object", or "I detected an obstacle", and an instruction or action from the user, and outputs the result of recognition to the application layer 41 (FIG. 5).

The application layer 41 is constituted by five modules, that is, an action model library 70, an action switching module 71, a learning module 72, an emotion model 73, and an instinct model 74, as shown in FIG. 5.

Figure 6:
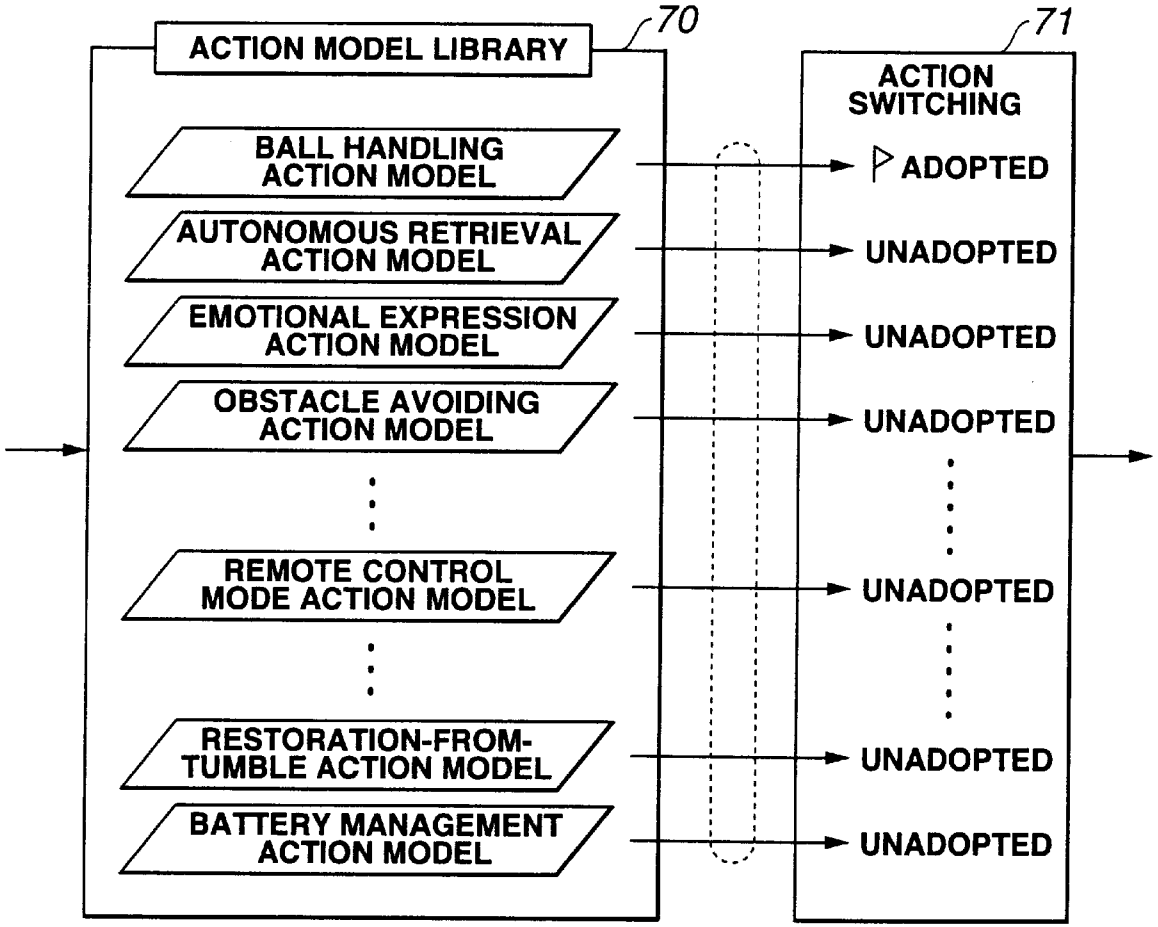
FIG. 6 is a block diagram showing the configuration of an action model library in the application layer.

In the action model library 70, independent action models $\mathbf{70}_1$ to $\mathbf{70}_n$ are provided corresponding to several condition items which are selected in advance such as "the case where the remaining battery capacity is short", "the case of restoring from a tumble", "the case of avoiding an obstacle", "the case of expressing an emotion", and "the case where a ball is detected", as shown in FIG. 6.

When the result of recognition is provided from the input semantics converter module 59 or when a predetermined time has passed since the last recognition result was provided, the action models $\mathbf{70}_1$ to $\mathbf{70}_n$ decide subsequent actions, if necessary, with reference to a parameter value of a corresponding emotion held in the emotion model 73 and a parameter value of a corresponding desire held in the instinct model 74 as will be described later, and output the results of decision to the action switching module 71.

Figure 7:
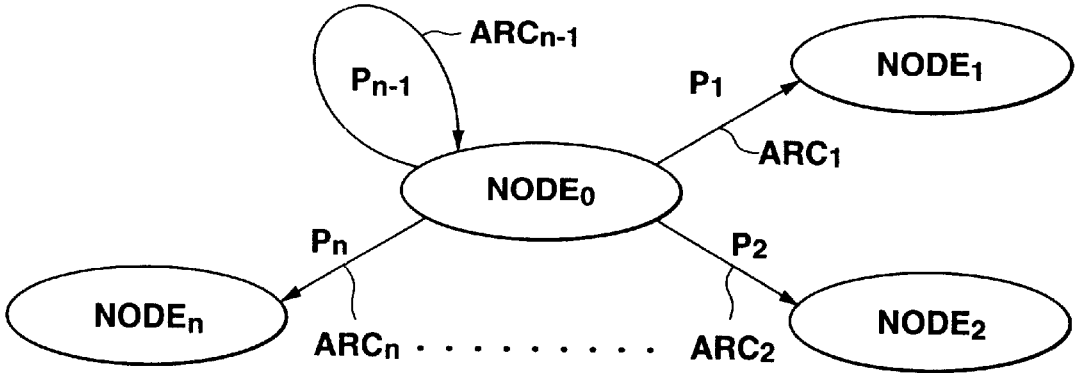
FIG. 7 is a view for explaining a finite probability automaton, which is information for action decision of the robot device.

In this embodiment, as a technique of deciding subsequent actions, the action models $\mathbf{70}_1$ to $\mathbf{70}_n$ use an algorithm called finite probability automaton such that which one of nodes (states) $NODE_0$ to $NODE_n$ becomes the destination of transition from another one of the nodes $NODE_0$ to $NODE_n$ is decided in terms of probability on the basis of transition probabilities $P_1$ to $P_n$, set for arcs $ARC_1$ to $ARC_{n1}$ connecting the respective nodes $NODE_0$ to $NODE_n$, as shown in FIG. 7.

Specifically, the action models $\mathbf{70}_1$ to $\mathbf{70}_n$ have a state transition table 80 as shown in FIG. 8 for each of the node $NODE_0$ to $NODE_n$, corresponding to the nodes $NODE_0$ to $NODE_n$ forming their respective action models $\mathbf{70}_1$ to $\mathbf{70}_n$.

In the state transition table 80, input events (results of recognition) as transition conditions at the nodes $NODE_0$ to $NODE_n$ are listed in the row of "name of input event" in the preferential order, and further conditions with respect to the transition conditions are described the corresponding columns in the rows of "name of data" and "range of data".

Therefore, at a node $NODE_{100}$ shown in the state transition table 80 of FIG. 8, the conditions for transition to another node are that if the result of recognition to the effect that "a ball is detected (BALL)" is provided, the "size (SIZE)" of the ball provided together with the result of recognition is within a range of "0 to 1000", and that if the result of recognition to the effect that "an obstacle is detected (OBSTACLE)" is provided, the "distance (DISTANCE)" to the obstacle provided together with the result of recognition is within a range of "0 to 100".

At this node $NODE_{100}$, even if there is no input of any result of recognition, transition to another node can be made when the parameter value of any of "joy", "surprise" and "sadness" held in the emotion model 73 is within a range of "50 to 100", of the parameter values of emotions and desires held in the emotion model 73 and the instinct model 74 which are periodically referred to by the action models $\mathbf{70}_1$ to $\mathbf{70}_n$.

In the state transition table 80, the name of nodes to which transition can be made from the nodes $NODE_0$ to $NODE_n$ are listed in the column of "transition destination node" in the section of "transition probability to other nodes". Also, the transition probabilities to the other nodes $NODE_0$ to $NODE_n$ to which transition can be made when all the conditions described in the rows of "name of input event", "name of data" and "range of data" are met are described in corresponding parts in the section of "transition probability to other nodes". Actions that should be outputted in transition to the nodes $NODE_0$ to $NODE_n$ are described in the row of "output action" in the section of "transition probability to other nodes". The sum of the probabilities of the respective rows in the section of "transition probability to other nodes" is 100%.

Therefore, at the node $NODE_{100}$ shown in the state transition table 80 of FIG. 8, for example, if there is provided the result of recognition to the effect that "a ball is detected (BALL)" and that the "size" of the ball is within a range of "0 to 1000", transition to a "node $NODE_{120}$" can be made with a probability of "30%" and an action of "ACTION 1" is outputted then.

The actions models $\mathbf{70}_1$ to $\mathbf{70}_n$ are constituted so that a number of such nodes $NODE_0$ to $NODE_n$ described in the form of the state transition tables 80 are connected. When the result of recognition is provided from the input semantics converter module 59, the actions models $\mathbf{70}_1$ to $\mathbf{70}_n$ decide next actions in terms of probability by using the state transition tables of the corresponding nodes $NODE_0$ to $NODE_n$ and output the results of decision to the action switching module 71.

In a user recognition system, which will be described later, different action models for constructing action information based on the finite probability automaton are provided for different users, and the robot device 1 decides its action in accordance with the action model (finite probability automaton) corresponding to the identified one user. By changing the transition probability between nodes, the action is varied for each identified user.

The action switching module 71 selects an action outputted from the action model of the action models $\mathbf{70}_1$ to $\mathbf{70}_n$ that has the highest predetermined priority, of the actions outputted from the action models $\mathbf{70}_1$ to $\mathbf{70}_n$ of the action model library 70, and transmits a command to the effect that the selected action should be executed (hereinafter referred to as action command) to the output semantics converter module 68 of the middleware layer 40. In this embodiment, higher priority is set for the action models $\mathbf{70}_1$ to $\mathbf{70}_n$ described on the lower side in FIG. 6.

On the basis of action completion information provided from the output semantics converter module 68 after the completion of the action, the action switching module 71 notifies the learning module 72, the emotion model 73 and the instinct model 74 of the completion of the action.

The learning module 72 inputs the result of recognition of teaching received as an action from the user, like "being hit" or "being stroked", of the results of recognition provided from the input semantics converter module 59.

On the basis of the result of recognition and the notification from the action switching module 71, the learning module 72 changes the transition probabilities corresponding to the action models $\mathbf{70}_1$ to $\mathbf{70}_n$ in the action model library 70 so as to lower the probability of manifestation of the action when it is "hit (scolded)" and to raise the probability of manifestation of the action when it is "stroked (praised)".

The emotion model 73 holds parameters indicating the strengths of 6 emotions in total, that is, "joy", "sadness", "anger", "surprise", "disgust", and "fear". The emotion model 73 periodically updates the parameter values of these emotions on the basis of the specific results of recognition such as "being hit" and "being stroked" provided from the input semantics converter module 59, the lapse of time, and the notification from the action switching module 71.

Specifically, the emotion model 73 calculates a parameter value E(t+1) of the emotion in the next cycle, using the following equation (1), wherein ΔE(t) represents the quantity of variance in the emotion at that time point calculated in accordance with a predetermined operation expression on the basis of the result of recognition provided from the input semantics converter module 59, the action of the robot device 1 at that time point and the lapse of time from the previous update, and $k_e$ represents a coefficient indicating the intensity of the emotion. The emotion model 73 then updates the parameter value of the emotion by replacing it with the current parameter value E(t) of the emotion. The emotion model 73 similarly updates the parameter values of all the emotions.

$$E(t+1)=E(t)+ke\times\Delta E(t) \quad (1)$$

To what extent the results of recognition and the notification from the output semantics converter module 68 influence the quantity of variance ΔE(t) in the parameter value of each emotion is predetermined. For example, the result of recognition to the effect that it was "hit" largely affects the quantity of variance ΔE(t) in the parameter value of the emotion of "anger", and the result of recognition to the effect that it was "stroked" largely affects the quantity of variance ΔE(t) in the parameter value of the emotion of "joy".

The notification from the output semantics converter module 68 is so-called feedback information of the action (action completion information), that is, information about the result of manifestation of the action. The emotion model 73 also changes the emotions in accordance with such information. For example, the emotion level of "anger" is lowered by taking the action of "barking". The notification from the output semantics converter module 68 is also inputted in the learning module 72, and the learning module 72 changes the transition probabilities corresponding to the action models $\mathbf{70}_1$ to $\mathbf{70}_n$ on the basis of the notification.

The feedback to the result of the action may also be carried out through the output of the action switching module 71 (action with emotion).

The instinct model 74 holds parameters indicating the strengths of 4 desires which are independent of one another, that is, "desire for exercise (exercise)", "desire for affection (affection)", "appetite", and "curiosity". The instinct model 74 periodically updates the parameter values of these desires on the basis of the results of recognition provided from the input semantics converter module 59, the lapse of time, and the notification from the action switching module 71.

Specifically, with respect to "desire for exercise", "desire for affection" and "curiosity", the instinct model 74 calculates a parameter value I(k+1) of the desire in the next cycle, using the following equation (2) in a predetermined cycle, wherein ΔI(k) represents the quantity of variance in the desire at that time point calculated in accordance with a predetermined operation expression on the basis of the results of recognition, the lapse of time and the notification from the output semantics converter module 68, and $k_i$ represents a coefficient indicating the intensity of the desire. The instinct model 74 then updates the parameter value of the desire by replacing the result of calculation with the current parameter value I(k) of the desire. The instinct model 74 similarly updates the parameter values of the desires except for "appetite".

$$I(k+1)=I(k)+ki\times\Delta I(k) \quad (2)$$

To what extent the results of recognition and the notification from the output semantics converter module 68 influence the quantity of variance ΔI(k) in the parameter value of each desire is predetermined. For example, the notification from the output semantics converter module 68 largely affects the quantity of variance ΔI(k) in the parameter value of "fatigue".

The parameter value may also be decided in the following manner.

For example, a parameter value of "pain" is provided. "Pain" affects "sadness" in the emotion model 73.

On the basis of the number of times an abnormal posture is taken, notified of via the signal processing module 55 for posture detection and the input semantics converter module 59 of the middleware layer 40, a parameter value I(k) of "pain" is calculated using the following equation (3), wherein N represents the number of times, $K_1$ represents the strength of pain, and $K_2$ represents a constant of the speed of reduction in pain. Then, the parameter value of "pain" is changed by replacing the result of calculation with the current parameter value I(k) of pain. If I(k) is less than 0, I(k)=0, t=0, and N=0 are used.

$$I(k)=K_1\times N-K_1\times t \quad (3)$$

Alternatively, a parameter value of "fever" is provided. On the basis of temperature data from the signal processing module 51 for temperature detection, provided via the input semantics converter module 59, a parameter value I(k) of "fever" is calculated using the following equation (4), wherein T represents the temperature, $T_0$ represents the ambient temperature, and $K_3$ represents a temperature rise coefficient. Then, the parameter value of "fever" is updated by replacing the result of calculation with the current parameter value I(k) of fever. If $T-T_0$ is less than 0, I(k)=0 is used.

$$I(k)=(T-T_0)\times K_3 \quad (4)$$

With respect to "appetite" in the instinct model 74, on the basis of the remaining battery capacity data (information obtained by a module for detecting the remaining battery capacity, not shown) provided via the input semantics converter module 59, a parameter value I(k) of "appetite" is calculated using the following equation (5) in a predetermined cycle, wherein $B_L$ represents the remaining battery capacity. Then, the parameter value of "appetite" is updated by replacing the result of calculation with the current parameter value I(k) of appetite.

$$I(k)=100-B_L \quad (5)$$

Alternatively, a parameter value of "thirst" is provided. On the basis of the speed of change in the remaining battery capacity provided via the input semantics converter module 59, a parameter value I(k) of "thirst" is calculated using the following equation (6) wherein $B_L(t)$ represents the remaining battery capacity at a time point t and the remaining battery capacity data is obtained at time points $t_1$ and $t_2$. Then, the parameter value of "thirst" is updated by replacing the result of calculation with the current parameter value I(k) of thirst.

$$I(k)=\{B_L(t_2)-B_L(t_1)\}/(t_2-t_1) \quad (6)$$

In the present embodiment, the parameter values of the emotions and desires (instincts) are regulated to vary within a range of 0 to 100. The values of the coefficients $k_e$ and $k_i$ are individually set for each of the emotions and desires.

Meanwhile, the output semantics converter module 68 of the middleware layer 40 provides abstract action commands such as "move forward", "be pleased", "bark or yap", or "tracking (chase a ball)" provided from the action switching module 71 in the application layer 41, to the corresponding signal processing modules 61 to 67 in the recognition system 69, as shown in FIG. 4.

As the action commands are provided, the signal processing modules 61 to 67 generate servo command values to be provided to the corresponding actuators $\mathbf{25}_1$ to $\mathbf{25}_n$ for carrying out the actions, and sound data of a sound to be outputted from the speaker 24 (FIG. 2) and/or driving data to be supplied to the LED of the "eyes", on the basis of the action commands. The signal processing modules 61 to 67 then sequentially transmit these data to the corresponding actuators $\mathbf{25}_1$ to $\mathbf{25}_n$, the speaker 24, or the LED, via the virtual robot 33 of the robotic server object 32 and the signal processing circuit 14 (FIG. 2).

In this manner, on the basis of the control program, the robot device 1 can autonomously acts in response to the status of the device itself, the ambient status, and the instruction or action from the user.

(3) Change of Instinct and Emotion in Accordance with Environment

In the robot device 1, in addition to the above-described configuration, the emotions and instincts are changed in accordance with the degrees of three conditions, that is, "noise", "temperature", and "illuminance" (hereinafter referred to as ambient conditions), of the ambient. For example, the robot device 1 becomes cheerful when the ambient is "bright", whereas the robot device 1 becomes quiet when the ambient is "dark".

Specifically, in the robot device 1, a temperature sensor (not shown) for detecting the ambient temperature is provided at a predetermined position in addition to the CCD camera 20, the distance sensor 22, the touch sensor 21 and the microphone 23 as the external sensors for detecting the ambient status. As the corresponding configuration, the signal processing modules 50 to 52 for noise detection, temperature detection, and brightness detection are provided in the recognition system 60 of the middleware layer 40.

The signal processing module for noise detection 50 detects the ambient noise level on the basis of the sound data from the microphone 23 (FIG. 2) provided via the virtual robot 33 of the robotic server object 33, and outputs the result of detection to the input semantics converter module 59.

The signal processing module for temperature detection 51 detects the ambient temperature on the basis of the sensor data from the temperature sensor provide via the virtual robot 33, and outputs the result of detection to the input semantics converter module 59.

The signal processing module for brightness detection 52 detects the ambient illuminance on the basis of the image data from the CCD camera 20 (FIG. 2) provided via the virtual robot 33, and outputs the result of detection to the input semantics converter module 59.

The input semantics converter module 59 recognizes the degrees of the ambient "noise", "temperature", and "illuminance" on the basis of the outputs from the signal processing modules 50 to 52, and outputs the result of recognition to the internal state models in the application layer 41 (FIG. 5).

Specifically, the input semantics converter module 59 recognizes the degree of the ambient "noise" on the basis of the output from the signal processing module for noise detection 50, and outputs the result of recognition to the effect that "it is noisy" or "it is quiet" to the emotion model 73 and the instinct model 74.

The input semantics converter module 59 also recognizes the degree of the ambient "temperature" on the basis of the output from the signal processing module for temperature detection 51, and outputs the result of recognition to the effect that "it is hot" or "it is cold" to the emotion model 73 and the instinct model 74.

Moreover, the input semantics converter module 59 recognizes the degree of the ambient "illuminance" on the basis of the output from the signal processing module for brightness detection 52, and outputs the result of recognition to the effect that "it is bright" or "it is dark" to the emotion model 73 and the instinct model 74.

The emotion model 73 periodically changes each parameter value in accordance with the equation (1) on the basis of the results of recognition supplied from the input semantics converter module 59 as described above.

Then, the emotion model 73 increases or decreases the value of the coefficient $k_e$ in the equation (1) with respect to the predetermined corresponding emotion on the basis of the results of recognition of "noise", "temperature", and "illuminance" supplied from the input semantics converter module 59.

Specifically, when the result of recognition to the effect that "it is noisy" is provided, the emotion model 73 increases the value of the coefficient $k_e$ with respect to the emotion of "anger" by a predetermined number. On the other hand, when the result of recognition to the effect that "it is quiet" is provided, the emotion model 73 decreases the coefficient $k_e$ with respect to the emotion of "anger" by a predetermined number. Thus, the parameter value of "anger" is changed by the influence of the ambient "noise".

Meanwhile, when the result of recognition to the effect that "it is hot" is provided, the emotion model 73 decreases the value of the coefficient $k_e$ with respect to the emotion of "joy" by a predetermined number. On the other hand, when the result of recognition to the effect that "it is cold" is provided, the emotion model 73 increases the coefficient $k_e$ with respect to the emotion of "sadness" by a predetermined number. Thus, the parameter value of "sadness" is changed by the influence of the ambient "temperature".

Moreover, when the result of recognition to the effect that "it is bright" is provided, the emotion model 73 increases the value of the coefficient $k_e$ with respect to the emotion of "joy" by a predetermined number. On the other hand, when the result of recognition to the effect that "it is dark" is provided, the emotion model 73 increases the coefficient $k_e$ with respect to the emotion of "fear" by a predetermined number. Thus, the parameter value of "fear" is changed by the influence of the ambient "illuminance".

Similarly, the instinct model 74 periodically changes the parameter value of each desire in accordance with the equations (2) to (6) on the basis of the results of recognition supplied from the input semantics converter module 59 as described above.

The instinct model 74 increases or decreases the value of the coefficient $k_i$ in the equation (2) with respect to the predetermined corresponding desire on the basis of the results of recognition of "noise", "temperature", and "illuminance" supplied from the input semantics converter module 59.

Specifically, when the result of recognition to the effect that "it is noisy" or "it is bright" is provided, the instinct model 74 decreases the value of the coefficient $k_i$ with respect to "fatigue" by a predetermined number. On the other hand, when the result of recognition to the effect that "it is quiet" or "it is dark" is provided, the instinct model 74 increases the coefficient $k_i$ with respect to "fatigue" by a predetermined number. When the result of recognition to the effect that "it is hot" or "it is cold" is provided, the instinct model 74 increases the coefficient $k_i$ with respect to "fatigue" by a predetermined number.

Consequently, in the robot device 1, when the ambient is "noisy", the parameter value of "anger" tends to increase and the parameter value of "fatigue" tends to decrease. Therefore, the robot device 1 behaves in such a manner that it looks "irritated" as a whole. On the other hand, when the ambient is "quiet", the parameter value of "anger" tends to decrease and the parameter value of "fatigue" tends to increase. Therefore, the robot device 1 behaves in such a manner that it looks "calm" as a whole.

When the ambient is "hot", the parameter value of "joy" tends to decrease and the parameter value of "fatigue" tends to increase. Therefore, the robot device 1 behaves in such a manner that it looks "lazy" as a whole. On the other hand, when the ambient is "cold", the parameter value of "sadness" tends to increase and the parameter value of "fatigue" tends to increase. Therefore, the robot device 1 behaves in such a manner that it looks like "feeling cold" as a whole.

When the ambient is "bright", the parameter value of "joy" tends to increase and the parameter value of "fatigue" tends to decrease. Therefore, the robot device 1 behaves in such a manner that it looks "cheerful" as a whole. On the other hand, when the ambient is "dark", the parameter value of "joy" tends to increase and the parameter value of "fatigue" tends to increase. Therefore, the robot device 1 behaves in such a manner that it looks "quiet" as a whole.

The robot device 1, constituted as described above, can change the state of emotions and instincts in accordance with the information of the robot device itself and the external information, and can autonomously act in response to the state of emotions and instincts.

(4) Structure for User Recognition

Figure 9:
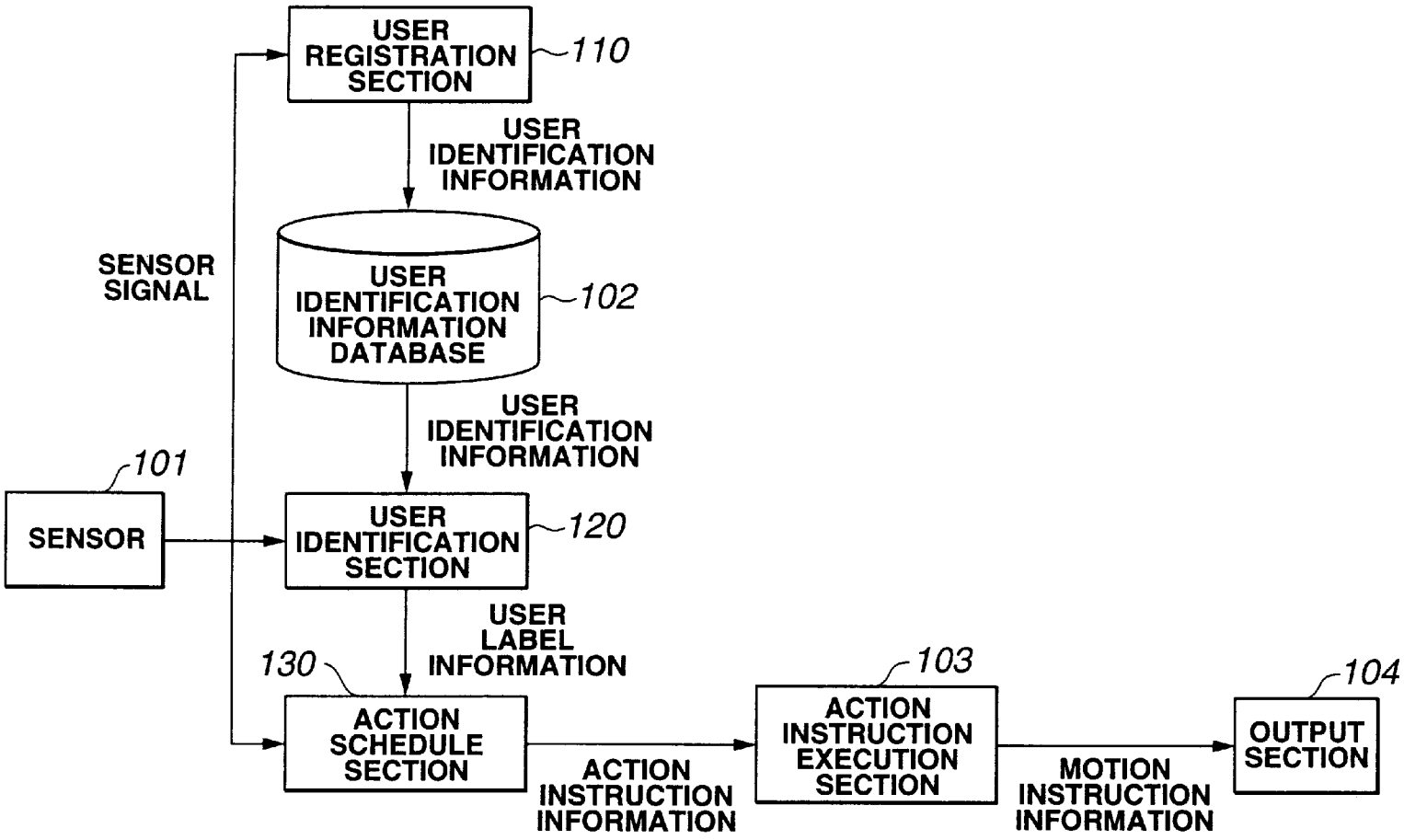
FIG. 9 is a block diagram showing a user recognition system of the robot device.

The application of the present invention to the robot device will now be described in detail. The robot device to which the present invention is applied is constituted to be capable of identifying a plurality of users and reacting differently to the respective users. A user identification system of the robot device 1 which enables different reactions to the respective users is constituted as shown in FIG. 9.

The user identification system has a sensor 101, a user registration section 110, a user identification section 120, a user identification information database 102, an action schedule section 130, an action instruction execution section 103, and an output section 104.

In the user identification system, the user identification section 120 identifies users on the basis of an output from the sensor 101. In this case, one user is identified with reference to information about a plurality of users which is registered in advance in the user identification information database 102 by the user registration section 110. The action schedule section 130 generates an action schedule corresponding to the one user on the basis of the result of identification from the user identification section 120, and an action is actually outputted by the action instruction execution section 103 and the output section 104 in accordance with the action schedule generated by the action schedule section 130.

In such a structure, the sensor 101 constitutes detection means for detecting information about a user, and the user identification section 120 constitutes identification means for identifying one user from a plurality of identifiable users on the basis of the information about a user detected by the sensor 101. The action schedule section 130, the action instruction execution section 103 and the output section 104 constitute action control means for causing manifestation of an action corresponding to the one user identified by the user identification section 120.

The user registration section 110 constitutes registration means for registering information about a plurality of users (user identification information) to the user identification information database 102 in advance. The constituent parts of such a user identification system will now be described in detail.

Figure 10:
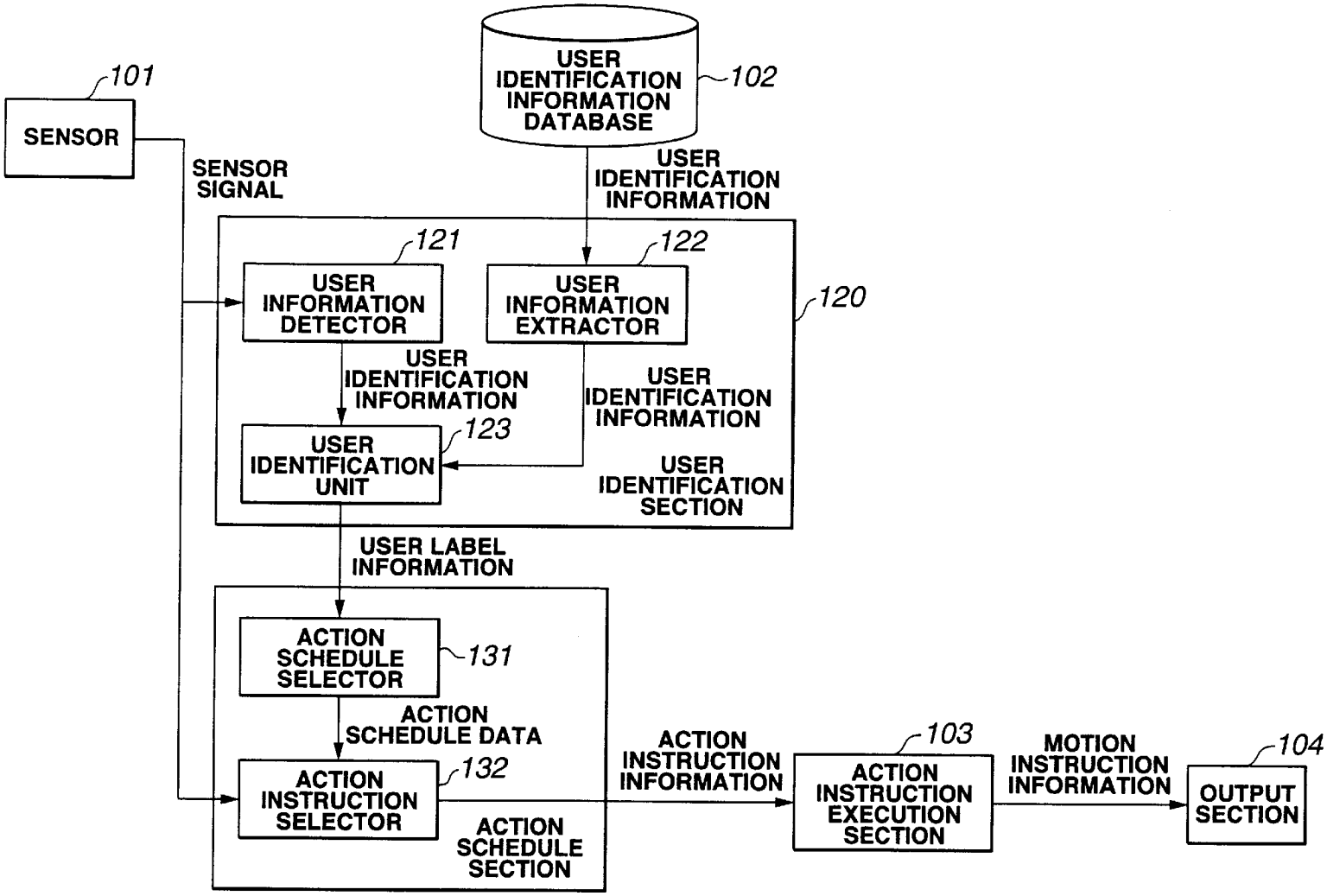
FIG. 10 is a block diagram showing a user identification section and an action schedule section in the user recognition system.

The user identification section 120 identifies one user from a plurality of registered users. Specifically, the user identification section 120 has a user information detector 121, a user information extractor 122 and a user identification unit 123, as shown in FIG. 10, and thus identifies one user.

The user information detector 121 converts a sensor signal from the sensor 101 to user identification information (user identification signal) to be used for user identification. The user information detector 121 detects the characteristic quantity of the user from the sensor signal and converts it to user identification information. In this case, the sensor 101 may be detection means capable of detecting the characteristics of the user, like the CCD camera 20 shown in FIG. 2 for detecting image information, the touch sensor 21 for detecting pressure information, or the microphone 23 for detecting sound information. For example, the CCD camera 20 detects a characteristic part of the face as the characteristic quantity, and the microphone 23 detects a characteristic part of the voice as the characteristic quantity.

The user information detector 121 outputs the detected user identification information to the user identification unit 123. Information from the user information extractor 122 (registered user identification information) is also inputted to the user identification unit 123.

The user information extractor 122 extracts the user identification information (user identification signal) which is registered in advance, from the user identification information database 102 and outputs the extracted user identification information (hereinafter referred to as registered user identification information) to the user identification unit 123.

In this case, the user identification information database 102 is constructed by a variety of information related to users, including the registered user identification information for user identification. For example, the characteristic quantity of the user is used as the registered user identification information. Registration of the user identification information to the user identification information database 102 is carried out by the user registration section 110 shown in FIG. 9.

Figure 11:
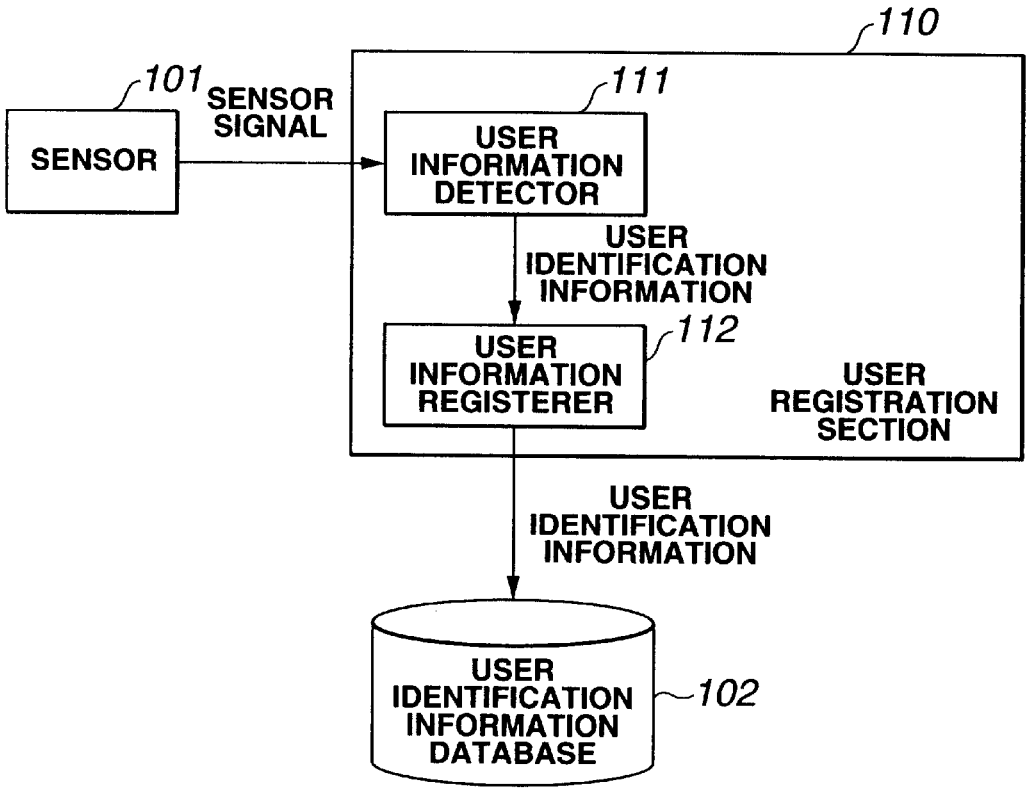
FIG. 11 is a block diagram showing a user registration section in the user recognition system.

Specifically, the user registration section 110 has a user information detector 111 and a user information registered 112, as shown in FIG. 11.

The user information detector 111 detects information (sensor signal) from the sensor 101 as user identification information (user identification signal). In the case where the sensor 101 is the CCD camera 20, the touch sensor 21 or the microphone 23 as described above, the user information detector 111 outputs image information, pressure information or sound information outputted from such a sensor 101 to the user information registered 112 as user identification information.

Moreover, in order to enable comparison between the user identification information detected by the user information detector 121 of the user identification section 120 and the registered user identification information registered to the user identification information database 102, the user information detector 111 outputs information of the same output format as that of the user information detector 121 of the user identification section 120, to the user information registered 112. That is, for example, the user information detector 111 detects, from the sensor signal, the user characteristic quantity which is similar to the characteristic quantity of the user detected by the user information detector 121 of the user identification section 120.

Furthermore, a switch or button for taking the user identification information is provided in the robot device 1, and the user information detector 111 starts intake of the user identification information in response to an operation of this switch or button by the user.

The user information registered 112 writes the user identification information from the user information detector 111 to the user identification information database 102.

The user identification information is registered in advance to the user identification information database 102 by the user registration section 110 as described above. Through similar procedures, the user identification information of a plurality of users is registered to the user identification information database 102.

Referring again to FIG. 10, the user identification unit 123 of the user identification section 120 compares the user identification information from the user information detector 121 with the registered user identification information from the user information extractor 122, thus identifying the user. For example, the user identification information is compared by pattern matching. In the case where the user identification information is made up of the characteristic quantity of the user, processing of pattern matching for user identification can be carried out at a high speed.

Priority may be given to the registered user identification information. Although comparison of the user identification information is carried out with respect to a plurality of users, it is possible to start comparison with predetermined registered user identification information with reference to the priority and thus specify the user in a short time.

For example, higher priority is given a user whom the robot device 1 came contact with on a greater number of occasions. In this case, the robot device 1 takes up the identification record of the user and gives priority to the registered user identification information on the basis of the record information. That is, as the robot device 1 came contact with the user on a greater number of occasions, higher priority is given, and the registered user identification information with high priority is used early as an object of comparison. Thus, it is possible to specify the user in a short time.

The user identification unit 123 outputs the result of identification thus obtained, to the action schedule section 130. For example, the user identification unit 123 outputs the identified user information as a user label (user label signal).

The user identification section 120 thus constituted by the user information detector 121 and the like compares the user identification information detected from the sensor 101 with the registered user identification information which is registered in advance, thus identifying the user. The user identification section 120 will be later described in detail, using an example in which the user is identified by a pressure sensor.

The action schedule section 130 selects an action corresponding to the user. Specifically, the action schedule section 130 has an action schedule selector 131 and an action instruction selector 132, as shown in FIG. 10.

The action schedule selector 131 selects action schedule data as action information on the basis of the user label from the user identification section 120. Specifically, the action schedule selector 131 has a plurality of action schedule data corresponding to a plurality of users and selects action schedule data corresponding to the user label. The action schedule data is necessary information for deciding the future action of the robot device 1 and is constituted by a plurality of postures and actions which enable transition to one another. Specifically, the action schedule data is the above-described action model and action information in which an action is prescribed by a finite probability automaton.

The action schedule selector 131 outputs the selected action schedule data corresponding to the user label to the action instruction selector 132.

The action instruction selector 132 selects an action instruction signal on the basis of the action schedule data selected by the action schedule selector 131 and outputs the action instruction signal to the action instruction execution section 103. That is, in the case where the action schedule data is constructed as a finite probability automaton, the action instruction signal is made up of information for realizing a motion or posture (target motion or posture) to be executed at each node (NODE).

The action schedule section 130 thus constituted by the action schedule selector 131 and the like selects the action schedule data on the basis of the user label, which is the result of identification from user identification section 120. Then, the action schedule section 130 outputs the action instruction signal based on the selected action schedule data to the action instruction execution section 103.

The mode of holding the action schedule data (finite probability automaton) in the action schedule selector 131 will now be described.

Figure 12:
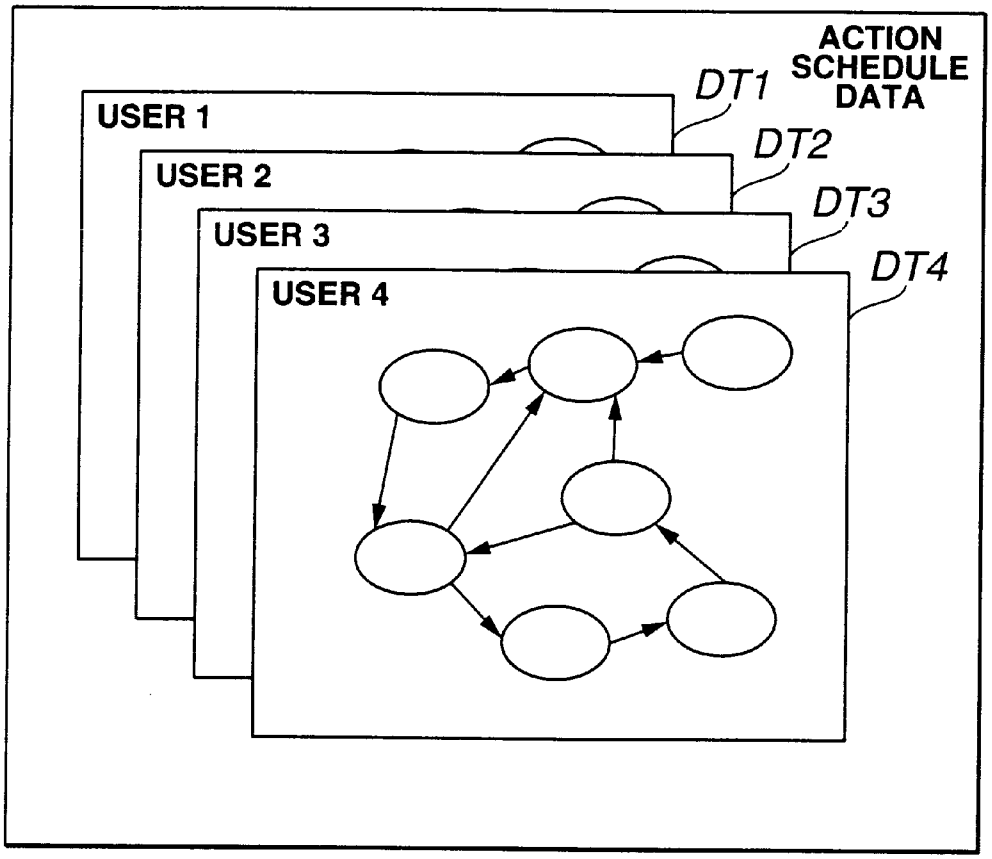
FIG. 12 shows action schedule data as action information of the robot device, in which a finite probability automaton corresponding to a plurality of users is used.

The action schedule selector 131 holds a plurality of finite probability automatons (action schedule data) DT1, DT2, DT3, DT4 corresponding to a plurality of users, as shown in FIG. 12. Thus, the action schedule selector 131 selects a corresponding finite probability automaton in accordance with the user label and outputs the selected finite probability automaton to the action instruction selector 132. The action instruction selector 132 outputs an action instruction signal on the basis of the finite probability automaton selected by the action schedule selector 131.

Figure 13:
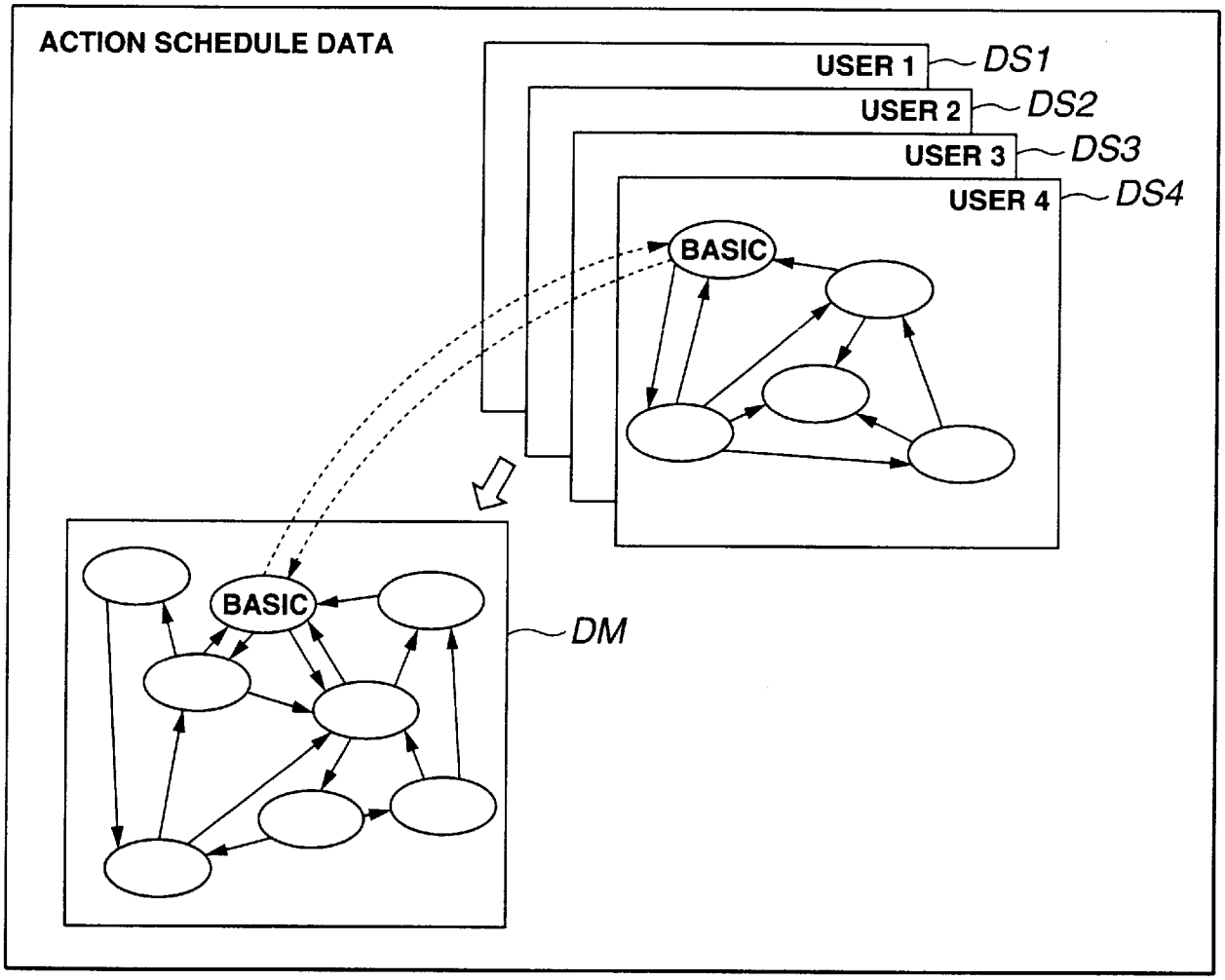
FIG. 13 shows action schedule data as action information of the robot device, in which a part of a finite probability automaton is prepared in accordance with a plurality of users.

Alternatively, the action schedule selector 131 can hold finite probability automatons for prescribing actions, with a part thereof corresponding to each user, as shown in FIG. 13. That is, the action schedule selector 131 can hold a finite probability automaton DM of a basic part and finite probability automatons DS1, DS2, DS3, DS4 for respective users, as the action schedule data.

In the example shown in FIG. 12, one finite probability automaton is held as complete data corresponding to a plurality of users. However, as shown in FIG. 13, it is also possible to hold a part of the finite probability automaton for each user. Although the feature of the present invention is that the robot device 1 reacts differently to different users, the reaction need not necessarily be different with respect to all the actions and some of general actions may be common.

Thus, the action schedule selector 131 holds a part of the finite probability automaton in accordance with a plurality of users. In such a case, by setting a basic node in the finite probability automaton DM of the basic part and the finite probability automatons DS1, DS2, DS3, DS4 prepared specifically for the respective users, it is possible to connect two finite automatons and handle them as a single piece of information for action decision.

By thus holding a part of the finite probability automaton in accordance with a plurality of users instead of holding the entire finite probability automaton, the quantity of data to be held can be reduced. As a result, the memory resource can be effectively used.

Figure 14:
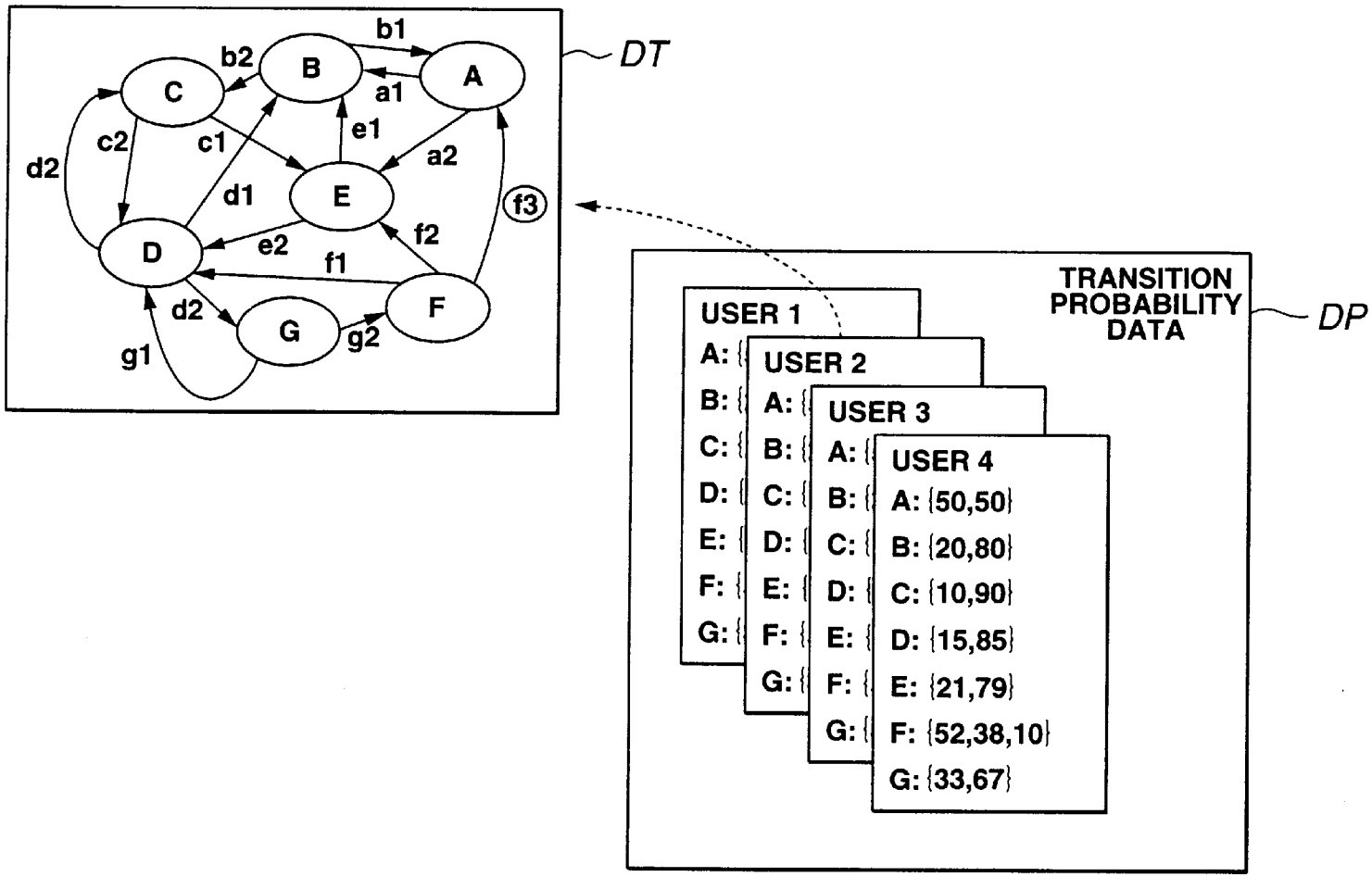
FIG. 14 shows the case where transition probability data of a finite probability automaton is prepared in accordance with a plurality of users.

The action schedule selector 131 can also hold action schedule data corresponding to each user as transition probability data DP, as shown in FIG. 14.

As described above, the finite probability automaton prescribes transition between nodes by using the probability. The transition probability data can be held in accordance with a plurality of users. For example, as shown in FIG. 14, the transition probability data DP is held corresponding to a plurality of users in accordance with the address of each arc in the finite probability automaton DT. In the example shown in FIG. 14, the transition probability data of arcs connected from nodes "A", "B", "C", . . . to other nodes are held and the transition probability of the arc of the finite probability automaton is prescribed by the transition probability data of "user 2".

As the transition probability provided for the arc of the finite probability automaton is held for each user, it is possible to prepare uniform nodes (postures or motions) regardless of the user and to vary the transition probability between nodes depending on the user. Thus, the memory resource can be effectively used in comparison with the case where the finite probability automaton is held for each user as described above.

The action schedule data as described above is selected by the action schedule selector 131 in accordance with the user, and the action instruction selector 132 outputs action instruction information on the basis of the action schedule data to the action instruction execution section 103 on the subsequent stage.

The action instruction execution section 103 outputs a motion instruction signal for executing the action on the basis of the action instruction signal outputted from the action schedule section 130. Specifically, the above-described output semantics converter module 68 and the signal processing modules 61 to 67 correspond to these sections.

The output section 104 is a moving section driven by a motor or the like in the robot device 1, and operates on the basis of the motion instruction signal from the action instruction execution section 103. Specifically, the output section 104 is each of the devices controlled by commands from the signal processing module 61 to 67.

The structure of the user identification system and the processing in each constituent section are described above. The robot device 1 identifies the user by using such a user identification system, then selects action schedule data corresponding to the user on the basis of the result of identification, and manifests an action on the basis of the selected action schedule data. Thus, the robot device 1 reacts differently to different users. Therefore, reactions based on interactions with each user can be enjoyed and the entertainment property of the robot device 1 is improved.

In the above-described embodiment, the present invention is applied to the robot device 1. However, the present invention is not limited to the this embodiment. For example, the user identification system can also be applied to a mimic organism or a virtual organism displayed on a display of a computer system.

In the above-described embodiment, the action schedule data prepared for each user is a finite probability automaton. However, the present invention is not limited to this. What is important is that data such as an action model for prescribing the action of the robot device 1 is prepared for each user.

It is also possible to prepare a matching set for each user. A matching set is an information group including a plurality of pieces of information for one user. Specifically, the information group includes characteristic information for each user such as different facial expressions and different voices obtained with respect to one user.

After specifying (identifying) the user, pattern matching of a facial expression or an instruction from the user is carried out by using the matching set of the user, thus enabling a reaction to the user at a high speed, that is, a smooth interaction with the user. This processing is based on the assumption that after one user is specified, the user in contact with the robot device 1 is not changed.

The specific structure of the user identification section 120 will now be described with reference to the case of identifying the user by pressing the pressure sensor.

Figure 15:
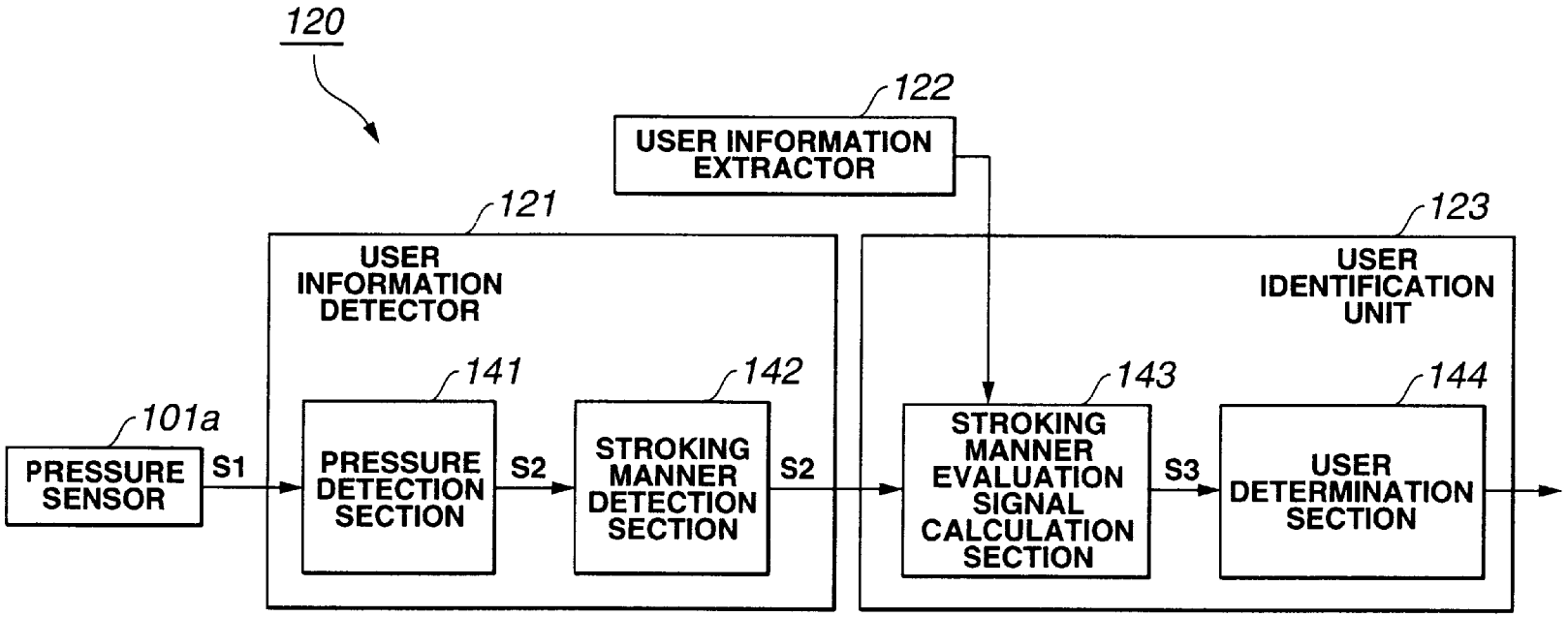
FIG. 15 is a block diagram showing the specific structure of the user identification section in the user recognition system.

For example, in the user identification section 120, the user information detector 121 has a pressure detection section 141 and a stroking manner detection section 142, and the user identification unit 123 has a stroking manner evaluation signal calculation section 143 and a user determination section 144, as shown in FIG. 15. A pressure sensor 101*a* is used as a sensor.

The pressure detection section 141 is supplied with an electric signal S1 from the pressure sensor 101*a* attached to the chin portion or the head portion of the robot device 1. For example, the pressure sensor 101*a* attached to the head portion is the above-described touch sensor 21.

The pressure detection section 141 detects that the pressure sensor 101*a* was touched, on the basis of the electric output S1 from the pressure sensor 101*a*. A signal (pressure detection signal) S2 from the pressure detection section 141 is inputted to the stroking manner detection section 142.

The stroking manner detection section 142 recognizes that the chin or head was stroked, on the basis of the input of the pressure detection signal S2. Normally, other information is inputted to the pressure sensor 101*a*. For example, the robot device 1 causes the pressure sensor 101*a* (touch sensor 21) to detect an action of "hitting" or "stroking" by the user and executes an action corresponding to "being scolded" or "being praised", as described above. That is, the output from the pressure sensor 101*a* is also used for other purposes than to generate the information for user identification. Therefore, the stroking manner detection section 142 recognizes whether the pressure detection signal S2 is for user identification or not.

Specifically, if the pressure detection signal S2 is inputted roughly in a predetermined pattern, the stroking manner detection section 142 recognizes that the pressure detection signal S2 is an input for user identification. In other words, only when the pressure detection signal S2 is in a predetermined pattern, it is recognized that the pressure detection signal S2 is a signal for user identification.

By thus using the pressure detection section 141 and the stroking manner detection section 142, the user information detector 121 detects the signal for user identification from the signals inputted from the pressure sensor 101*a*. The pressure detection signal (user identification information) S2 recognized as the signal for user identification by the stroking manner detection section 142 is inputted to the stroking manner evaluation signal calculation section 143.

The stroking manner evaluation signal calculation section 143 obtains evaluation information for user identification from the pressure detection signal S2 inputted thereto. Specifically, the stroking manner evaluation signal calculation section 143 compares the pattern of the pressure detection signal S2 with a registered pattern which is registered in advance, and obtains an evaluation value as a result of comparison. The evaluation value obtained by the stroking manner evaluation signal calculation section 143 is inputted as an evaluation signal S3 to the user determination section 144. On the basis of the evaluation signal S3, the user determination section 144 determines the person who stroked the pressure sensor 101*a*.

The procedure for obtaining the evaluation information of the user by the stroking manner evaluation signal calculation section 143 will now be described in detail. In this case, the user is identified in accordance with both the input from the pressure sensor provided on the chin portion and the input from the pressure sensor (touch sensor 21) provided on the head portion.

The stroking manner evaluation signal calculation section 143 compares the contact pattern which is registered in advance (registered contact pattern) with the contact pattern which is actually obtained from the pressure sensor 101*a* through stroking of the chin portion or the head portion (actually measured contact pattern).

Figure 16:
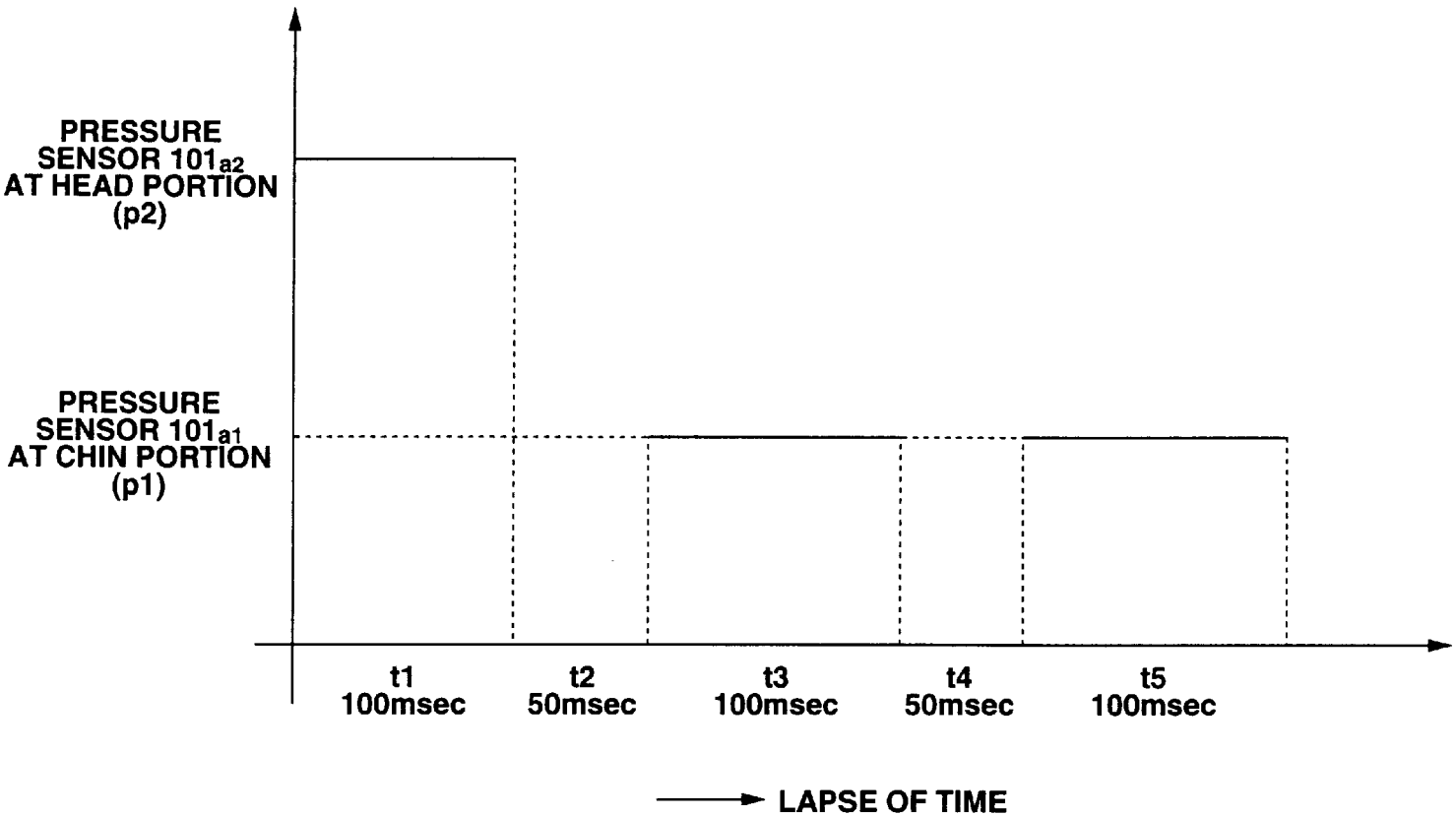
FIG. 16 is a graph for explaining a registered contact pattern.

The case where the registered contact pattern is registered as a pattern as shown in FIG. 16 will now be described. The registered contact pattern serves as the registered user identification information registered to the user identification information database 102.

The registered contact pattern shown in FIG. 16 is constituted by an arrangement of a contact (press) time of the pressure sensor 101$a_1$ on the chin portion, a contact (press) time of the pressure sensor 101$a_2$ (touch sensor 21) on the head portion, and a non-contact (non-press) time during which neither one of the pressure sensors 101$a_1$, 101$a_2$ is touched.

The contact pattern is not limited to this example. Although the registered contact pattern in this example shows that the pressure sensor 101$a_1$ on the chin portion and the pressure sensor 101$a_2$ on the head portion are not touched (pressed) simultaneously, it is also possible to use a registered contact pattern showing that the pressure sensor 101$a_1$ on the chin portion and the pressure sensor 101$a_2$ on the head portion are touched (pressed) simultaneously.

In the case where the data of the registered contact pattern is expressed by Di[ti,p] (i is an integer), where t represents a dimensionless quantity of time (time element) and p represents an output value of the pressure sensor (detection signal element), the registered contact pattern shown in FIG. 16 includes a set D of five data (i=1, 2, . . . , 5), that is, contact data D1 of the pressure sensor 101$a_1$ on the chin portion, non-contact data D2 of the pressure sensors, first contact data D3 of the pressure sensor 101$a_2$ on the head portion, non-contact data D4 of the pressure sensors, and second contact data D5 of the pressure sensor 101$a_2$ on the head portion, as shown in the following Table 1.

TABLE 1

| |
|---|
| D1 = [t1, p2] = [0.25, 2] |
| D2 = [t2, 0] = [0.125, 0] |
| D3 = [t3, p1] = [0.25, 1] |
| D4 = [t4, 0] = [0.125, 0] |
| D5 = [t5, p1] = [0.25, 1] |

The dimensionless quantity of time is made dimensionless on the basis of the total time T (100+50+100+50+100 (msec) of the registered contact pattern. p1 is an output value (for example, "1") of the pressure sensor 101$a_1$ on the chin portion, and p2 is an output value (for example, "2") of the pressure sensor 101$a_2$ on the head portion. The purpose of using the dimensionless time as the data of the contact pattern is to eliminate the time dependency and realize robustness in the conversion to the evaluation signal by the stroking manner evaluation signal calculation section 143.

Figure 17:
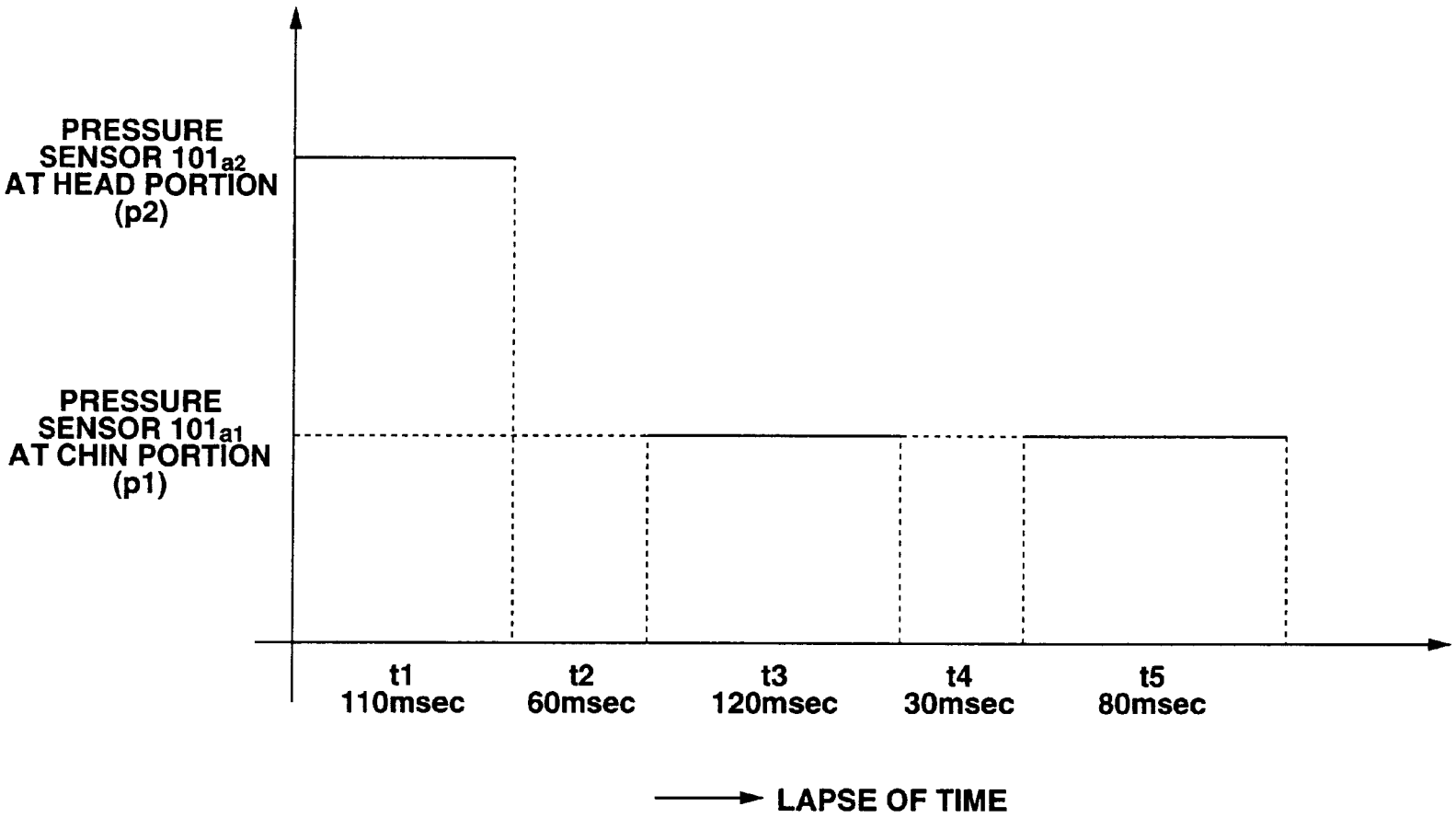
FIG. 17 is a graph for explaining an actually measured contact pattern.

A user who intends to be identified through comparison with the registered contact pattern as described above needs to stroke the pressure sensor 101*a* in such a manner as to match the registered pattern. For example, it is assumed that an actually measured contact pattern as shown in FIG. 17 is obtained as the user operates the pressure sensors 101$a_1$, 101$a_2$ on the chin portion and the head portion in trying to be identified.

If the data of the actually measured contact pattern is expressed by Di'[ti',p] (i is an integer), where t' represents a dimensionless quantity of time, the actually measured contact pattern shown in FIG. 17 includes a set D' (=D1', D2', D3', D4', D5') of five data (i=1, 2, . . . , 5) D1', D2', D3', D4', D5' as shown in the following Table 2.

TABLE 2

| |
|---|
| D1' = [t1', p2] = [0.275, 2] |
| D2' = [t2', 0] = [0.15, 0] |
| D3' = [t3', p1] = [0.3, 1] |
| D4' = [t4', 0] = [0.075, 0] |
| D5' = [t5', p1] = [0.2, 1] |

The stroking manner evaluation signal calculation section 143 compares the actually measured contact pattern expressed in the above-described format, with the registered contact pattern. At the time of comparison, the registered contact pattern is read out from the user identification information database 102 by the user information extractor 122.

Specifically, the actually measured data D1', D2', D3', D4', D5' constituting the actually measured contact pattern are collated with the registered data D1, D2, D3, D4, D5 constituting the registered contact pattern, respectively.

In the collation, the time elements of the actually measured data D1', D2', D3', D4', D5' and those of the registered data D1, D2, D3, D4, D5 are compared with each other and a deviation between them is detected. Specifically, the five actually measured data are collated with the registered data and the distribution Su is calculated. The distribution Su is provided as an equation (9) from equations (7) and (8).

$$ui=ti-ti' \tag{7}$$

$$xu=\Sigma ui/5 \tag{8}$$

$$Su=\Sigma(ti-xu)^2/(5-1) \tag{9}$$

From this distribution, an evaluation value X is provided in accordance with an equation (10).

$$X=1-Su \tag{10}$$

Through the procedure as described above, the evaluation value X is obtained by the stroking manner evaluation signal calculation section 143.

The user determination section 144 carries out user determination (discrimination) on the basis of the evaluation value (evaluation signal S3) calculated by the stroking manner evaluation signal calculation section 143 as described above. Specifically, as the evaluation value is closer to "1", there is a higher probability of the "user". Therefore, a threshold value set at a value close to "1" and the evaluation value are compared with each other, and if the evaluation value exceeds the threshold value, the "user" is specified. Alternatively, the user determination section 144 compares the threshold value with the evaluation value, taking the reliability of the pressure sensor 101*a* into consideration. For example, the evaluation value is multiplied by the "reliability" of the sensor.

Figure 18:
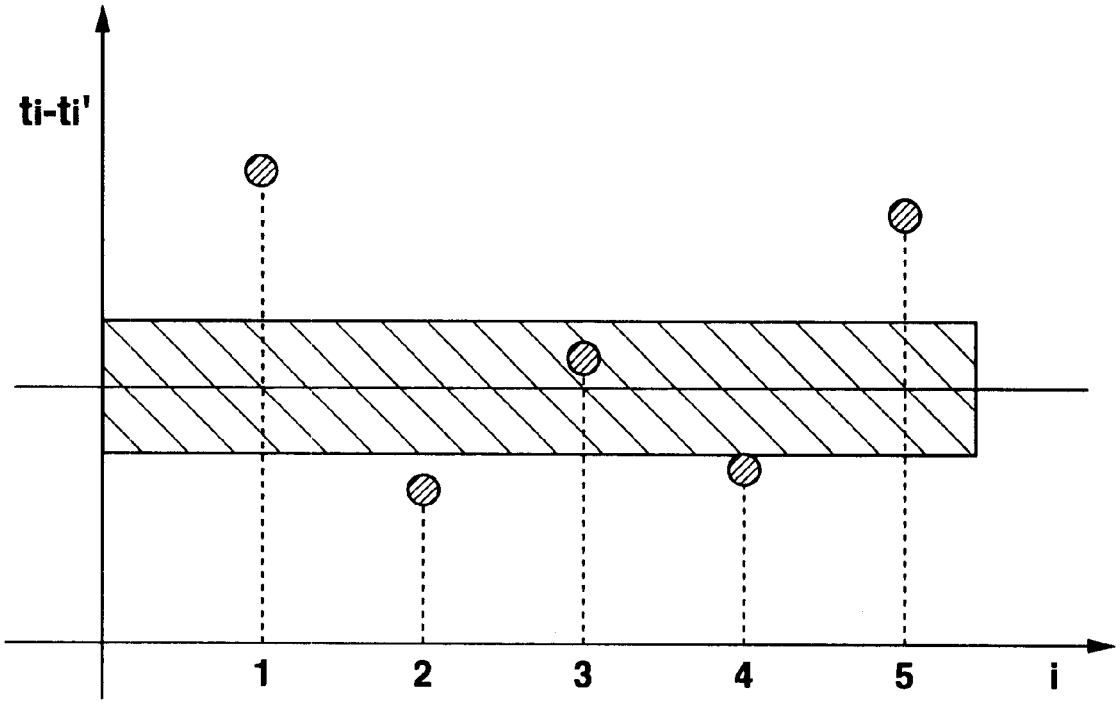
FIG. 18 is a graph for explaining dispersion of evaluation information of the user.

Meanwhile, in the user determination by the user determination section 144, the difference between the actually measured time and the registered time (or the distribution between the dimensionless quantity of the actually measured time and the dimensionless quantity of the registered time) is found. For example, in the case where the difference (ti−ti') between the dimensionless quantity of time ti of the registered contact pattern and the dimensionless quantity of time ti' of the actually measured contact pattern is considered, incoherent data as a whole is generated as shown in FIG. 18. Therefore, it is difficult for even the true user to press the pressure sensor 101*a* perfectly in conformity with the registered contact pattern. The reliability of the pressure sensor 101*a* must also be considered.

Thus, by using the distribution as the evaluation value, it is possible to carry out accurate collation.

Figure 19:
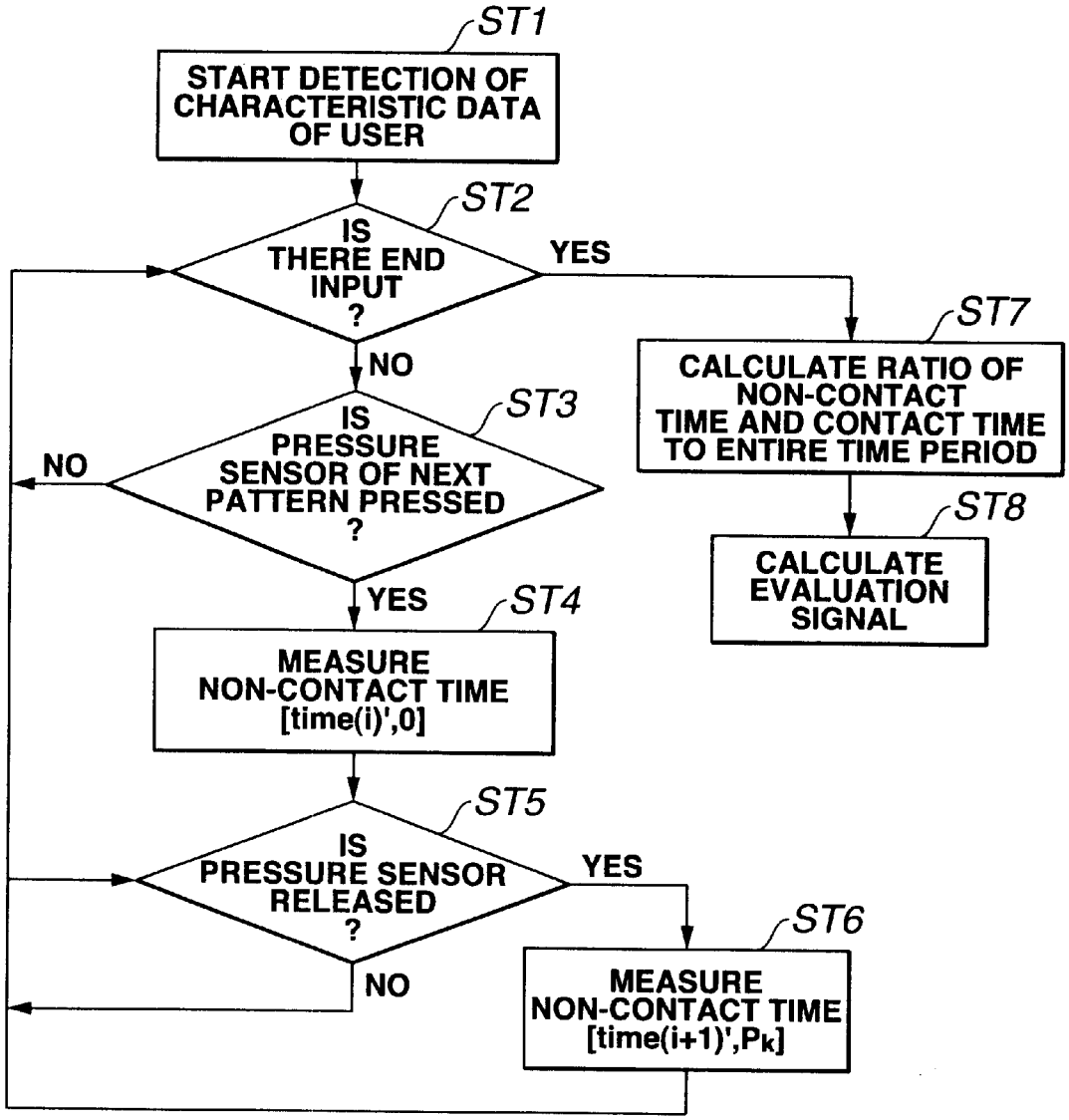
FIG. 19 is a flowchart showing the procedure for obtaining an actually measured contact pattern and obtaining an evaluation signal.

The above-described evaluation value is obtained through the procedure as shown in FIG. 19.

At step ST1, detection of the characteristic data of the user (data constituting the actually measured contact pattern) is started. At the next step ST2, it is discriminated whether or not there is an input for ending the user identification. If there is an input for ending, the processing goes to step ST7. If there is no input for ending, the processing goes to step ST3.

Specifically, if there is no input from the pressure sensor 101*a* for a predetermined time period, an input for ending the user identification is provided from the upper control section to the data obtaining section (stroking manner detection section 142 or stroking manner evaluation signal calculation section 143). In accordance with this input, at and after step ST7, the processing to obtain the pressure detection signal S2 is ended at the stroking manner detection section 142, or the calculation of the evaluation value is started at the stroking manner evaluation signal calculation section 143.

Meanwhile, at step ST3, it is discriminated whether the pressure sensor 101*a* of the next pattern is pressed or not. If the pressure sensor 101*a* of the next pattern is pressed, the pressure sensor 101*a* at step ST4 obtains data of the non-contact time (time(i)', 0) until the pressure sensor 101*a* is pressed. In this case, time(i)' represents an actually measured time which is not made dimensionless.

At the subsequent steps ST5 and ST6, it is discriminated whether the hand is released from the pressure sensor 101*a* or not, and data of the contact time (time(i+1)',p) is obtained. Specifically, at step ST5, self-loop is used in discrimination as to whether the hand is released from the pressure sensor 101*a,* and if the hand is released from the pressure sensor 101*a,* the processing goes to step ST6 to obtain the data of the non-contact time (time(i+1)',p) until the pressure sensor 101*a* is pressed. After the data of the non-contact time (time(i+1)',p) is obtained at step ST6, whether or not there is an input for ending is discriminated again at step ST2.

At step ST7 as a result of discrimination to the effect that there is an input for ending at step ST2, the ratio of the contact time of the pressure sensor 101*a* and the non-contact time of the pressure sensor to the entire time period is calculated. That is, data of the dimensionless contact time and non-contact time is obtained. Specifically, the entire time period T of actual measurement is calculated in accordance with an equation (11), where time(i)' represents the actually measured time during which the pressure sensor 101*a* is pressed, and data ti' of the actually measured time as a dimensionless quantity is calculated in accordance with an equation (12). Thus, a set of data Di'[ti, p] of the actually measured contact pattern is calculated.

$$T=\Sigma \text{time}(i)' \tag{11}$$

$$ti'=time(i)'/T \tag{12}$$

At the next step ST8, the evaluation value (evaluation signal) is calculated in accordance with the above-described procedure. Thus, the evaluation value can be obtained. On the basis of such an evaluation value, the user determination section 144 determines the user.

By thus using the stroking manner evaluation signal calculation section 143 and the user determination section 144, the user identification unit 123 compares the user identification information (actually measured contact pattern) from the stroking manner detection section 142 with the registered user identification information (registered contact pattern) from the user information extractor 122 and identifies the user. The user identification unit 123 outputs the specified user (information) as a user label to the action schedule section 130, as described above.

The user recognition system in the robot device 1 is described above. By using the user identification system, the robot device 1 can identify the user and can react differently to different users. Thus, the entertainment property of the robot device 1 is improved.

In the robot according to the present invention, on the basis of information of a user detected by detection means for detecting information of a user, one user is identified from a plurality of identifiable users by identification means, and an action corresponding to the one user identified by the identification means is manifested by action control means. Therefore, the robot can identify one user from a plurality of identifiable users and can react corresponding to the one user.

In the action deciding method for a robot according to the present invention, on the basis of information of a user detected by detection means, one user is identified from a plurality of identifiable users and an action corresponding to the identified one user is manifested. Therefore, the robot can identify one user from a plurality of identifiable users and can react corresponding to the one user.

What is claimed is:

1. A robot comprising:

detection means for detecting information of a user;

identification means for identifying one user from a plurality of identifiable users on the basis of the information of the user detected by the detection means; and action control means for manifesting an action corresponding to the one user identified by the identification means, said action being designated in accordance with a finite probability automation scheme.

2. The robot as claimed in claim 1, wherein information about a plurality of users is registered in advance and held, and a plurality of pieces of action information are held corresponding to the plurality of users;

the identification means identifies one user on the basis of the information of the user registered in advance and the information of the user detected by the detection means; and the action control means manifests an action on the basis of action information corresponding to the one user.

3. The robot as claimed in claim 2, further comprising registration means for registering the information of the user in advance.

4. The robot as claimed in claim 1, wherein the action information is made up of a finite probability automation, which is a transition diagram of a plurality of postures and motions.

5. The robot as claimed in claim 1, wherein a motor is controlled to drive a moving section by the action control means, thus manifesting an action.

6. An action deciding method for a robot comprising the steps of identifying one user from a plurality of identifiable users on the basis of information of the user detected by detection means, and manifesting an action corresponding to the identified one user, said action being designated in accordance with a finite probability automation scheme.

* * * * *